US007948509B2

(12) United States Patent
Yamazaki et al.

(10) Patent No.: US 7,948,509 B2
(45) **Date of Patent: *May 24, 2011**

(54) LINE HEAD AND IMAGE FORMING DEVICE USING THE SAME

(75) Inventors: Katsunori Yamazaki, Nagano (JP); Takao Miyazawa, Nagano (JP); Akira Nakajima, Nagano (JP); Yujiro Nomura, Nagano (JP); Kiyoshi Tsujino, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 203 days.

This patent is subject to a terminal disclaimer.

(21) Appl. No.: 12/333,069

(22) Filed: Dec. 11, 2008

(65) Prior Publication Data

US 2009/0141113 A1 Jun. 4, 2009

Related U.S. Application Data

(63) Continuation of application No. 11/858,513, filed on Sep. 20, 2007, now Pat. No. 7,499,067, which is a continuation of application No. 10/981,387, filed on Nov. 4, 2004, now Pat. No. 7,286,147.

(30) Foreign Application Priority Data

| | | |
|---|---|---|
| Nov. 5, 2003 | (JP) | 2003-375357 |
| Nov. 5, 2003 | (JP) | 2003-375358 |
| Nov. 11, 2003 | (JP) | 2003-381250 |
| Nov. 11, 2003 | (JP) | 2003-381251 |
| Nov. 11, 2003 | (JP) | 2003-381252 |
| Nov. 27, 2003 | (JP) | 2003-396516 |
| Dec. 2, 2003 | (JP) | 2003-402552 |

(51) Int. Cl.
*B41J 2/45* (2006.01)

(52) U.S. Cl. ..... 347/130; 347/238

(58) Field of Classification Search ..... 347/130, 347/237, 238

See application file for complete search history.

(56) References Cited

U.S. PATENT DOCUMENTS

| | | | | |
|---|---|---|---|---|
| 4,779,108 | A | 10/1988 | Inoue | |
| 5,150,016 | A | 9/1992 | Sawase et al. | |
| 5,600,363 | A | 2/1997 | Anzaki et al. | |
| 6,297,842 | B1 | 10/2001 | Koizumi et al. | |
| 6,474,789 | B1 | 11/2002 | Ishinaga et al. | |
| 6,583,446 | B1 | 6/2003 | Taninaka et al. | |
| 6,787,811 | B2 | 9/2004 | Saito et al. | |
| 7,286,147 | B2 * | 10/2007 | Yamazaki et al. | 347/130 |
| 7,499,067 | B2 * | 3/2009 | Yamazaki et al. | 347/130 |
| 2003/0045016 | A1 | 3/2003 | Saito et al. | |
| 2004/0174426 | A1 | 9/2004 | Nomura et al. | |
| 2005/0276642 | A1 | 12/2005 | Ohki et al. | |

FOREIGN PATENT DOCUMENTS

| | | |
|---|---|---|
| JP | 61-248483 | 11/1986 |

(Continued)

*Primary Examiner* — Huan H Tran
(74) *Attorney, Agent, or Firm* — DLA Piper LLP (US)

(57) ABSTRACT

A line head, includes a light-emitting element row, having a plurality of light-emitting elements arranged in a first direction; a plurality of feeding portions; a first power supply line for power supply, connected to a first feeding portion for a power supply of the feeding portions; and a second power supply line for ground, connected to a second feeding portion for a ground of the feeding portions. The light-emitting elements are respectively connected between the first power supply line and the second power supply line.

18 Claims, 31 Drawing Sheets

FOREIGN PATENT DOCUMENTS

| | | | |
|---|---|---|---|
| JP | 62-151363 | | 7/1987 |
| JP | 63-104858 | | 5/1988 |
| JP | 64080561 | A | 3/1989 |
| JP | 02-054539 | | 4/1990 |
| JP | 02-076046 | | 6/1990 |
| JP | 03-061556 | | 3/1991 |
| JP | 05-061420 | | 3/1993 |
| JP | 05-131681 | | 5/1993 |
| JP | 05-088951 | | 12/1993 |
| JP | 06-064228 | | 3/1994 |
| JP | 06-064229 | | 3/1994 |
| JP | 08-000220 | | 2/1996 |
| JP | 08090832 | A | 4/1996 |
| JP | 08-187892 | | 7/1996 |
| JP | 08-230229 | | 9/1996 |
| JP | 08-324024 | | 12/1996 |
| JP | 09118033 | A | 5/1997 |
| JP | 10-226107 | | 8/1998 |
| JP | 11-188914 | | 7/1999 |
| JP | 11-198433 | | 7/1999 |
| JP | 2000-103111 | | 4/2000 |
| JP | 2001-205847 | | 7/2001 |
| JP | 2001-270150 | | 10/2001 |
| JP | 2002-331701 | | 11/2002 |
| JP | 2003001864 | A | 1/2003 |
| JP | 2003-152299 | A | 5/2003 |
| JP | 2003-154700 | | 5/2003 |
| JP | 2003207965 | A | 7/2003 |
| JP | 2003-234508 | | 8/2003 |

* cited by examiner

LINE HEAD AND IMAGE FORMING DEVICE USING THE SAME

CROSS-REFERENCE TO THE RELATED APPLICATIONS

This is a continuation of application Ser. No. 11/858,513 filed Sep. 20, 2007, which is a continuation of the application Ser. No. 10/981,387 filed Nov. 4, 2004, now a U.S. Pat. No. 7,286,147, the entire contents of which are incorporated by reference. This application also claims benefit of priority under 35 U.S.C §119 to Japanese Patent Application Nos. 2003-375357 and 2003-375358 both of which were filed Nov. 5, 2003, Japanese Patent Application Nos. 2003-381250, 2003-381251 and 2003-381252 which were filed Nov. 11, 2003, Japanese Patent Application No. 2003-396516 filed Nov. 27, 2003, and Japanese Patent No. 2003-402552 filed Dec. 2, 2003, the entire contents of all of which are incorporated by reference.

BACKGROUND OF THE INVENTION

The present invention relates to a line head in which a plurality of light-emitting elements are arranged in a line, which enables to equalize the amount of emitted light from the respective light-emitting elements, and an image forming device using the line head.

Also, the present invention relates to a line head in which a plurality of light-emitting elements are arranged in a line, and which enables to have evenness in quantity of emitted light, irregardless of turning-on patterns of the respective light-emitting elements, and an image forming device using the line head.

Further, the present invention relates to a line head which is configured so as to remove the variations in amount of light emitted from a plurality of light-emitting elements and to reduce the size of the line head when the plurality of light-emitting elements are arranged in one line, and to an image forming device using the line head.

An image forming device including a line head which has a plurality of light-emitting elements arranged in a line is developed. The line head is used as an exposing unit. JP-A-6-64229 describes that EL (electroluminescence) elements for one line are arranged in an optical printer head, and grayscale data corresponding to the respective EL elements is stored for every EL element. Further, in JP-A-11-198433, a printer head having a plurality of LED chips arranged in a line which can improve unevenness of light-emitting characteristic in a scanning line direction is described.

FIG. 34 is a diagram illustrating schematically an example of a wiring line configuration of a related organic EL element. In FIG. 34, a plurality of organic EL elements Ea are arranged in a line head 10 in a scanning line direction, to thereby form one light-emitting element line 1. Reference numerals 2 and 3 denote first and second power supply lines formed with thin film wiring lines, and reference numerals 6 and 7 denote feeding points. The feeding point 6 is provided at a power supply (VDD) side, and the feeding point 7 is provided at a ground (GND) side. Further, a reference numeral A denotes an anode electrode of the organic EL element Ea, and a reference numeral K denotes a cathode electrode thereof.

A reference numeral Tr2 denotes a drive transistor which is formed on the same substrate as the organic EL element Ea. A reference numeral D is a drain of the drive transistor Tr2 which is connected to the power supply line 2. A reference numeral G denotes a gate of the drive transistor Tr2, and a reference numeral S denotes a source of the drive transistor Tr2 which is connected to the anode electrode A of the organic EL elements Ea. Moreover, though not shown, the gate G is connected to a source of a control transistor Tr1 via a wiring line Ga. An external circuit 12 which extends to the lengthwise direction at a short side of a housing 11 of the line head is provided in the housing 11, and is connected to feeding points 6 and 7 by a feeding cable. Furthermore, a control signal line for controlling a control transistor (not shown) or a drive transistor which is formed in the light-emitting element line 1 is wired from the external circuit 12.

FIG. 35 is a circuit diagram of FIG. 34, and the same elements as those of FIG. 34 are represented by the same reference numerals. As shown in FIG. 35, in the control transistor Tr1, a signal line 4 of a gate and a signal line 5 of a drain are provided. Further, as described above, the drain of the drive transistor Tr2 is connected to the first power supply line 2, and to the gate thereof, the source of the control transistor Tr1 is connected. The respective organic EL elements arranged in the light-emitting element line 1 is connected between the first power supply line 2 to be connected to the feeding point 6 of the power supply (VDD) side, and the second power supply line 3 to be connected to the feeding point 7 of the ground (GND) side.

A light-emitting element using the organic EL element is a current-driven element, current flowing in the power supply line (VDD side) of a drain side of the drive transistor Tr2 and in the power supply line (GND side) of a cathode (cathode electrode) side of the light-emitting element increases or decreases according to the degree of light-emission of the light-emitting element. Here, the first and second power supply lines are formed with the thin film wiring lines, and the resistance values of both ends of each of the power supply lines are different from each other according to the size of the printer head. For example, the resistance values are in an order of several ohms to tens of ohms.

Further, when all the light-emitting elements are turned-on, the current of each of the light-emitting elements is in an order of at least ten mA, and voltages to be applied to the respective light-emitting elements reach tens of millivolts to hundred millivolts. Here, in the case in which the organic EL element is used as the light-emitting element, it is well-known that due to a slight difference of the applied voltages, the current changes, that is, the amount of emitted light of the respective light-emitting elements change greatly. Therefore, there may be a case in which the amount of emitted light change largely, in particular, according to distances from the respective light-emitting elements to the feeding points.

FIG. 36 is a simplified circuit diagram of FIG. 34. In FIG. 36, a left end organic EL element Ea is represented by a reference numeral E1 and a right end organic EL element Ea is represented by a reference numeral En. Reference numerals R and nR denote wiring line resistances. The reference numeral R denotes the wiring line resistance between the feeding points 6 and 7 and the left end organic EL element E1, and the reference numeral nR denotes the wiring line resistance between the left end organic EL element E1 and the right end organic EL element En.

When a voltage and a current between the feeding points 6 and 7 are V and i, respectively, an applied voltage of the organic EL element E1 is Vp1, and an applied voltage of the organic EL element En is Vpn, the expressions of Vp1=V−4Ri and Vpn=V−4Ri−4nRi are satisfied. In such a manner, when the plurality of light-emitting elements are arranged in a line, and the respective light-emitting elements are connected between the first and second common power supply lines, the voltages to be applied to the respective light-emitting elements are different from each other according to the distance from the feeding point. In FIG. 36, a voltage difference in the light-emitting elements at both ends of the line becomes large, and then the amount of emitted light are different from each other. Since the life span of the light-emitting element is shortened as brightness increases, unevenness in the life spans of the light-emitting elements is caused. Further, if the amount of emitted light are different from each other, the lowering of printing quality caused.

Further, different currents flow into the respective light-emitting elements arranged in a line due to turning-on patterns. That is, a current from a power supply line flows into the light-emitting element to be turned on, and a current from a power supply line doesn't flow into the light-emitting element to be turned off. Therefore, a potential of the power supply line which applies a voltage to the light-emitting element at a position of the light-emitting element to be turned on, and a potential of the power supply line at a position to be turned off are different. In such a manner, due to the shapes of the turning-on patterns, the light-emitting elements to be turned on and the light-emitting elements to be turned off exist in the line, and thus a change in potential of the power supply line is caused. For this reason, unevenness in quantity of emitted light of the respective light-emitting elements is caused.

Therefore, in the example of FIG. 36, a difference between voltages to be applied to the light-emitting elements becomes large due to positions to be connected to the line, and further the voltages to be applied to the respective light-emitting elements change due to the turning-on patterns. Thus, unevenness in quantity of emitted light is caused. Since the life span of the light-emitting element is shortened as brightness increases, unevenness in life span of the light-emitting elements is caused. Further, if irregularity in quantity of emitted light exists, the lowering of display quality is caused. In the example of FIG. 36, a difference between the voltages applied to the light-emitting elements is caused by a position of the connecting position with regard to the power supply line 2 of the light-emitting elements and a turning light pattern of the light-emitting elements. Therefore, when a slightly voltage variation between the power supply lines 2 and 3 is occurred by the disturbance, an influence for an amount of the light emitting of the light-emitting elements becomes larger.

In order to solve the above problems, it is preferable to broaden the widths of the first and second power supply lines 2 and 3. In this case, however, the width of the light-emitting element becomes large, and then the size of a printer increases. Further, in the case that a substrate having the same size is used, there is a problem in that the number of the right-emitting elements to be manufactured decreases. As another solution, it is preferable to form a thick power supply line. However, since the light-emitting element is formed with a multi-layered thin film process, it is impossible to form the power supply line thicker than is necessary. At most, the thickness of the power supply line is limited to about hundreds of micrometers.

Further, if only the power supply line is thickened extremely, a step difference with other layers becomes large, and then separations or defects of the thin film layers are caused. In addition, the line head has a shape long in a main scanning direction with a narrow width in a sub-scanning direction. In such a manner, since the shape of the line head is extremely long and slender, a curve is caused by a difference in thermal expansion coefficient with the substrate (glass). Moreover, if the thin film is thick, the time for forming the film becomes longer, and the man-hour rises. That is, there are many problems to be caused intrinsically by the shape of the line head or the manufacture of the light-emitting element.

In the devices described in JP-A-6-64229 and JP-A-11-198433, as shown in FIG. 34, all the feeding points connected to the first and second power supply lines are provided at the same side of the line. Further, the voltages to be applied to the respective light-emitting elements change by turn-on patterns. For this reason, there is a problem in that various problems described above are not solved. Further, there is a problem in that since the external circuit is provided at a short side of the line head in the lengthwise direction, the size of the housing of the line head increase, and thus the space is insufficient.

SUMMARY OF THE INVENTION

The present invention is made in consideration of the above problems of the related art, and it is a first object of the present invention to provide a line head configured so as to have a plurality of light-emitting elements which are arranged in a line to emit, the line head being enable to equalize the amount of emitted light of the respective light-emitting elements by devising positions of feeding points at which power supply lines are connected to the respective light-emitting elements. For this reason, there is a problem in that, even when a slight change in voltage between the power supply lines 2 and 3 is caused, influences on the quantity of emitted light increase due to unmeasured disturbances. Moreover, there is a problem in that even when an instant overvoltage is applied to the first and second power supply lines due to the unmeasured disturbances and the light-emitting elements may be damaged, the protective unit is not provided.

Also, a second object of the present invention is to provide a line head in which a plurality of light-emitting elements are arranged in a line, and the line head enabling to have evenness in quantity of emitted light, irregardless of turning-on patterns of the respective light-emitting elements, and an image forming device using the line head.

Further, a third object of the present invention is to provide a line head in which a plurality of light-emitting elements are arranged in a line to emit, and the line head enabling to have evenness in quantity of emitted light of the respective light-emitting elements and protects the light-emitting elements when an overvoltage is applied, and an image forming device using the line head.

Further, a fourth object of the present invention is to provide a line head which is configured so as to reduce the size of the housing of the line head so as to have a sufficient space, when the plurality of light-emitting elements are arranged in one line to emit light, and to an image forming device using the same.

In order to achieve the above object, according to the present invention, there is provided a line head, comprising:

a light-emitting element row, having a plurality of light-emitting elements arranged in a first direction;

a plurality of feeding portions;

a first power supply line for power supply, connected to a first feeding portion for a power supply of the feeding portions; and a second power supply line for ground, connected to a second feeding portion for a ground of the feeding portions, wherein the light-emitting elements are respectively connected between the first power supply line and the second power supply line.

Preferably, the first and second power supply lines are respectively thin film wiring lines.

Preferably, the first feeding portion is provided at an end portion of the first power supply line near to a contact portion on the first power supply line connecting to one of the light-emitting elements at the both ends of the light-emitting element row. The second feeding portion is provided at an end portion of the second power supply line near to a contact portion on the second power supply line connecting to the other of the light-emitting elements at the both ends of the light-emitting element row.

In the above configurations, the difference between voltages to be applied to the respective light-emitting elements is removed, and thus it is possible to equalize the amount of emitted light. Therefore, it is possible to average the life spans of the respective light-emitting elements, and further it is possible to prevent printing quality from lowering.

Preferably, the line head comprises a plurality of the light-emitting element rows. Each of the light-emitting element rows is arranged in a second direction perpendicular to the first direction. Even when the light-emitting element in the light-emitting element line which is turned on is out of order, it is possible to allow printing to be continuously performed without changing the line head.

Preferably, the line head further comprises a switch, selecting at least one of the light-emitting element rows to be turned on. Even when the light-emitting element line for a normal operation is defective, it is possible to meet immediately. Further, in case of the switch including a switching transistor, it is possible to allow the switching between the light-emitting element lines to be performed precisely and immediately.

Preferably, the light-emitting elements include organic EL elements or LEDs. Since the organic EL element can be statically controlled, it is possible to simply a control system. Further, in case of the LED, the manufacture of the light-emitting element is simplified.

Preferably, the feeding portions for power supply are provided at both ends of the first power supply line. The feeding portions for ground are provided at both ends of the second power supply line. In the above configuration, influences by voltage drops of the power supply lines can be reduced and a difference between voltages to be applied to the respective light-emitting elements can be removed. Thus, it is possible to equalize the amount of emitted light. Therefore, it is possible to average the life spans of the respective light-emitting elements, and further it is possible to prevent printing quality from lowering.

Preferably, the line head further comprises a third feeding portion, connected to the first power supply line;

a fourth feeding portion, connected to the second power supply line;

a third power supply line for the power supply, connected to the third feeding portion; and a fourth power supply line for the ground, connected to the fourth feeding portion.

In the above configuration, influences by the voltage drops of the power supply lines can be reduced and a difference between the voltages to be applied to the respective light-emitting elements can be removed. Thus, it is possible to equalize the amount of emitted light.

Preferably, the third feeding portion and the fourth feeding portion are provided at a vicinity of at least one of the feeding portions. In the above configuration, influences by voltage drops of the power supply lines can be reduced and a difference between voltages to be applied to the respective light-emitting elements can be removed. Thus, it is possible to equalize the amount of emitted light.

Preferably, the line head further comprises a first substrate, on which the light emitting element row, the plurality of feeding portions, the first power supply line and the second power supply line are provided;

a second substrate;

a first auxiliary power supply line, provided on the second substrate;

a second auxiliary power supply line, provided on the second substrate; and a conductive member, connecting the first power supply line to the first auxiliary power supply line and connecting the second power supply line to the second auxiliary power supply line.

In the above configuration, it is possible to suppress influences on the light-emitting elements by changes in voltage of the power supply lines. Therefore, it may be configured such that the amount of light emitted from the light-emitting elements arranged in a line can be equal to each other.

Preferably, the second substrate is arranged above the light-emitting element row of the first substrate so that the first and second auxiliary power supply lines are faced to the first and second power supply lines.

Preferably, the first auxiliary power supply line and the second auxiliary power supply line are planar shapes.

In the above configuration, it is possible to reduce the resistance values of the first auxiliary power supply line and the second auxiliary power supply line.

Preferably, the first auxiliary power supply line and the second auxiliary power supply line are comprised of a non-transparent material.

In the above configuration, lost light from the light-emitting elements is not emitted in an opposite direction to an image carrier. Thus, it is possible to prevent the image carrier from being exposed unnecessarily.

Preferably, the first and second auxiliary power supply lines are formed in the same pattern as the first and second power supply lines.

In the above configuration, additional designs or processing steps for creating the auxiliary power supply lines are not needed, and thus it is possible to easily manufacture the auxiliary power supply lines.

Preferably, the conductive member includes an adhesive containing a conductive particle. In the above configuration, connections between the respective feeding points of the power supply lines and the respective feeding points of the auxiliary power supply lines become strong, and thus it is possible to prevent the connections of both feeding points from being disconnected from each other.

Preferably, the second substrate is a moisture-proof member. As the moisture-proof plate, an additional member is not used, but a blank space is provided. Since the auxiliary power supply lines are formed in the moisture-proof plate, it is possible to use efficiently a space.

Preferably, the line head further comprises a substrate, having a first face and a second face which is opposed to the first face, the first face on which the light emitting element row, the plurality of feeding portions, the first power supply line and the second power supply line are provided;

a first auxiliary power supply line, provided on the second face;

a second auxiliary power supply line, provided on the second face; and a conductive member, connecting the first power supply line to the first auxiliary power supply line and connecting the second power supply line to the second auxiliary power supply line.

In the above configuration, tensions by the thin film conductive members on both sides of the substrate are competed. For this reason, a curve of the substrate is suppressed, as compared to the case in which the power supply lines are formed with the thin films on one side of the substrate. Therefore, the film thicknesses of the thin films can be made larger to lower the resistance values, and influences on the light-emitting elements by the changed in voltage can be reduced. Further, the power supply lines and the auxiliary power supply lines are connected in parallel on both sides of the substrate, and thus it is possible to reduce the resistance values.

Preferably, the first auxiliary power supply line and the second auxiliary power supply line are planar shapes. The first auxiliary power supply line and the second auxiliary power supply line are comprised of a non-transparent material. In the above configuration, it is possible to prevent light emitted from the light-emitting elements from leaking in a direction different from the direction of the image carrier as lost light.

Preferably, the line head further comprises a plurality of dummy loads, connected in parallel to the respective light-emitting elements, and into which the same current as the respective light-emitting elements flow, and a controller, turning-off the dummy loads when the light-emitting elements are turned on and turning-on the dummy loads when the light-emitting elements are turned off.

In the above configuration, a total current flowing into the connecting portions between the power supply lines to which the respective light-emitting elements are connected is constant in any connecting portions. Therefore, irregardless of light-emitting patterns, potentials of the power supply lines between the connecting portions to which the respective light-emitting elements are connected do not change. For this reason, irregularity in quantity of emitted light according to the turning-on states of the light-emitting elements is not caused. Thus, printing quality is advanced and unevenness in life span is suppressed.

Preferably, the dummy loads are light-emitting elements having the same characteristic as the light-emitting elements. In the above configuration, the current characteristics of the dummy loads are the same as those of the light-emitting elements. Thus, it is possible to suppress effectively influences by the changes in potential of the power supply lines. Further, since the dummy loads can be manufactured using the same processes as those of the light-emitting elements, it is possible to reduce the manufacturing cost of the dummy loads owing to mass production effect.

Preferably, the dummy loads are resistances. In this configuration, it has an advantage in that shielding of light to be emitted from the dummy loads is not needed. In this configuration, it has an advantage in that shielding of light to be emitted from the dummy loads is not needed.

Preferably, The line head according to claim 3, the resistances are thin film resistances which are deposited on a substrate on which the light-emitting elements are provided. In this configuration, a process for connecting the resistances to the connecting portions between the power supply lines is simplified. Further, the manufacture of the dummy load is simplified.

Preferably, the controller includes a pair of transistors which are respectively connected to the light-emitting elements and the dummy loads. Conductive layers of the respective transistors having different polarities. In this configuration, it is easy to form control signals to the pair of transistors.

Preferably, the controller includes a pair of transistors which are respectively connected to the light-emitting elements and the dummy loads. Conductive layers of the respective transistors having same polarities. The respective transistors are supplied with signals of which polarities are inverted to each other. In this configuration, it has an advantage in that a complicated process for manufacturing the pair of transistors is not needed.

Preferably, the line head further comprises a voltage change suppresser, suppressing a voltage change of the first and second power supply lines. The voltage change suppresser is connected between the first power supply line and the second power supply line.

In the above configuration, it is possible to reduce influences on the amount of light emitted from the light-emitting elements by a change in voltage between the power supply lines. Further, in the case in which an instant overvoltage is generated between the first power supply line and the second power supply line, the voltage change suppressing means for power supply line absorbs the overvoltage such that the overvoltage is not applied to the light-emitting elements. Thus, it is possible to prevent the light-emitting elements from being damaged.

Preferably, the line head further comprises a first FPC, arranged along a longitudinal side of the light-emitting element row;

a first external power supply line for the power supply, provided on the first FPC; and a second external power supply line for the ground, provided on the first FPC, wherein some of the feeding portions are provided at both ends of the first and second power supply lines and connected to the first and second external power supply lines respectively. The others of the feeding portions provided between the some of the feeding portions are connected to the first and second external power supply lines respectively.

In the above configuration, there is no difference in the voltage applied to the light-emitting elements, and it is possible to equalize the amount of emitted light. In addition, since the number of the feeding points increases, it is possible to suppress the influence on the light-emitting elements due to the change in voltage. Furthermore, since the FPC having flexibility is provided in the lengthwise direction and the wiring lines are mounted by using the FPC, it is possible to reduce the space of the line head. Therefore, even when the line head is bent, the wiring lines can be easily mounted.

Preferably, the line head further comprises a controller, generating a control signal to be supplied to the light-emitting elements and having a signal wire which is wired in the first FPC.

In the above configuration, since the external power supply line and the signal lines are commonly wired by using the FPC capable of wiring at a high density, the structure of the wiring lines are simple.

Preferably, the control signal is directly supplied to the light-emitting elements. In the above configuration, since the control signal is supplied from the signal line which is directly wired in FPC without providing the control circuit, the structure of the control system is simple.

Preferably, the line head further comprises a second FPC, arranged along at a short side of the light-emitting element row; and a controller, generating a control signal to be supplied to the light-emitting elements and having a signal wire which is wired in the second FPC.

In the above configuration, compared to the related structure, since the size at the short side of the line is shortened, it is possible to save the space for arranging.

Preferably, voltages at the respective feeding portions are adjusted by at least one of the first and second external power supply lines so as to reduce the variation of the brightness between the light-emitting elements. In the above configuration, it is possible to reduce the variation of the brightness of the light-emitting elements due to the difference in the property of the light-emitting elements based on the various reasons occurred during the manufacture, or the difference in voltages of the power supply line applied to the light-emitting elements. It is further possible to equalize the amount of emitted light.

According to the present invention, there is also provided an image forming apparatus, comprising:

at least two image forming stations, each having an image forming unit including a charging unit arranged around an image carrier, a line head according to any one of claims 1 to 18, a developing unit, and a transferring unit. A transferring medium passes through the respective image forming stations such that an image is formed in a tandem manner.

In the above configuration, voltages to be applied to the respective light-emitting elements provided in the line head can be equalized, thereby equalizing the amount of emitted light.

According to the present invention, there is also provided an image forming apparatus, comprising:

an image carrier configured to carry an electrostatic latent image, a rotary developing unit; and a line head according to any one of claims 1 to 18. The rotary developing unit holds toners stored in a plurality of toner cartridges on a surface of the rotary developing unit, rotates in a predetermined direction to sequentially transport toners of different colors to positions opposite to the image carrier, and applies a developing bias between the image carrier and the rotary developing unit to move the toners from the rotary developing unit to the image carrier such that the electrostatic latent image is developed to form a toner image.

In the above configuration, voltages to be applied to the respective light-emitting elements provided in the line head can be equalized, thereby equalizing the amount of emitted light.

Preferably, the image forming device further comprises an intermediate transferring member. In the above configuration, voltages to be applied to the respective light-emitting elements provided in the line head can be equalized, thereby equalizing the amount of emitted light. According to the present invention, in the case of which the plurality of light-emitting elements are arranged in a line to emit, the positions of the feeding points of the first and second power supply lines connected to the respective light-emitting elements are provided the opposite sides of the line respectively. Thus, when the power supply line is formed with the thin film wiring line, it is possible to obtain the line head which can equalize the amount of light emitted from the respective light-emitting elements, and the image information correcting unit using the line head.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 3A:
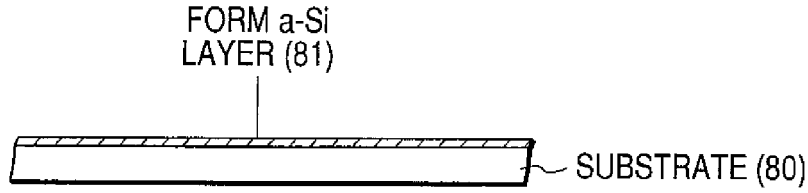
FIGS. 3A to 3E are diagrams showing a manufacturing process of the present invention.
Figure 3B:
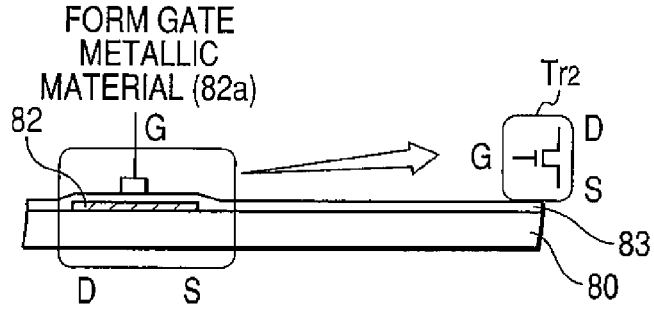

Hereinafter, the present invention will be described with reference to the drawings. FIGS. 3A to 3E are diagrams showing an example of a partial manufacturing process of a line head according to the present invention. In FIG. 3A, an amorphous silicon layer (a-Si layer) 81 is formed on a substrate 80 such as glass. In FIG. 3B, first, patterning is performed on the a-Si layer 1 to form a pattern 82. Subsequently, a silicon dioxide ($SiO_2$) insulating layer 83 is formed to cover the pattern 82 of the a-Si layer 81. And then, a gate metallic material 82*a* is formed. Here, a gate G, a drain D and a source S of a drive transistor. Tr2 are formed with the gate metallic material 82*a* and the pattern 82 at positions as shown in FIG. 3B in an expanded scale.

Figure 3C:
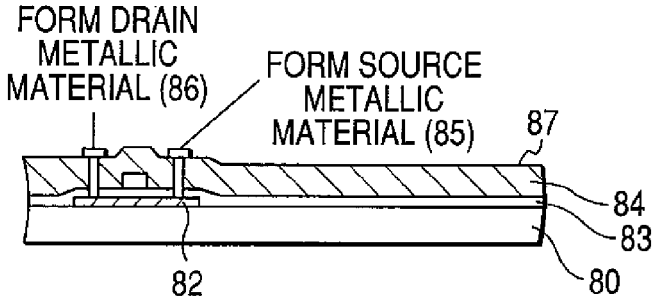

In FIG. 3C, a silicon dioxide ($SiO_2$) insulating layer 84 is formed on the silicon dioxide ($SiO_2$) insulating layer 83 and the gate metallic material 82*a*. Subsequently, two contact holes are formed to pass through from the surface of the insulating layer 84 to the surface of the pattern 82. In the contact holes, a source metallic material 85 and a drain metallic material 86 are formed.

Figure 3D:
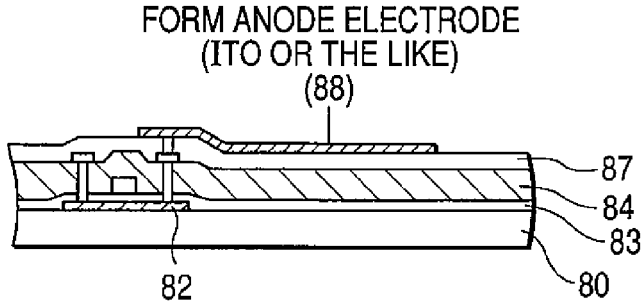
Figure 3E:
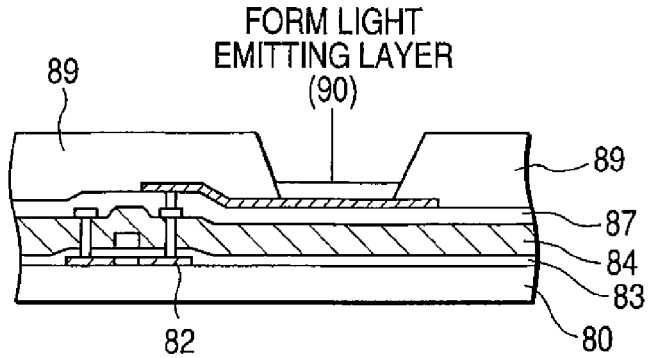

In FIG. 3D, a silicon dioxide ($SiO_2$) insulating layer 87 is formed on the silicon dioxide ($SiO_2$) insulating layer 84, the source metallic material 85 and the drain metallic material 86. Subsequently, a contact hole is formed to pass through from the surface of the insulating layer 87 to the surface of the source metallic material 85. A transparent electrode ITO (indium tin oxide) 88 of an anode side partially extends in the contact hole to have a contact portion with the source metallic material 85. That is, an anode electrode of the light-emitting element and a source of the drive transistor are electrically connected to each other. In FIG. 3E, partitions 89 are formed on the insulating layer 87 and the ITO 88. Subsequently, a light-emitting layer 90 is created in a space between the partitions 89 and 89.

Figure 4:
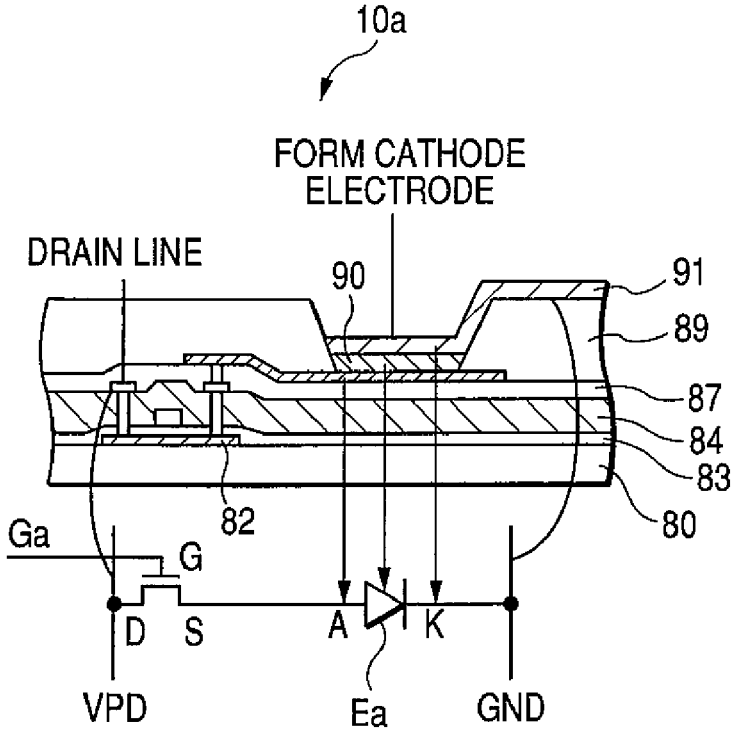
FIG. 4 is a diagram illustrating the embodiment of the present invention.

FIG. 4 is a diagram illustrating a configuration around the light-emitting element of a resultant line head associated with a circuit diagram. In FIG. 4, a cathode electrode 90 of the light-emitting element is additionally formed as compared to FIG. 3E. To the cathode electrode 90, a power supply line 91 of a ground side (GND side) formed with a thin film is connected. Further, to a drain line to be connected to the drain D of the drive transistor, a power supply line of another side (VDD side) is connected. The respective power supply lines extend in a lengthwise direction orthogonal to a paper and feed the plurality of light-emitting elements. Moreover, Ga denotes a signal line which is connected to a source of a control transistor Tr1.

Figure 5:
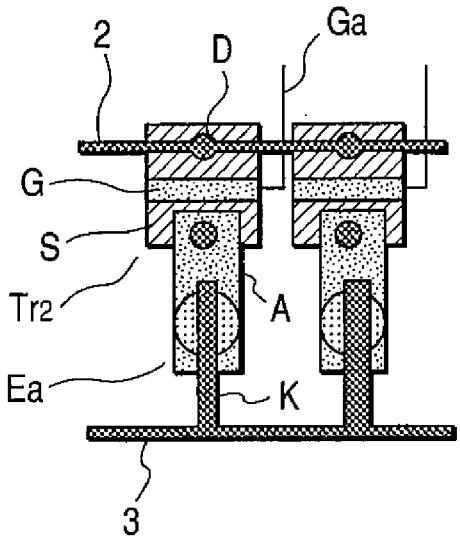
FIG. 5 is a diagram illustrating the embodiment of the present invention.
Figure 34:
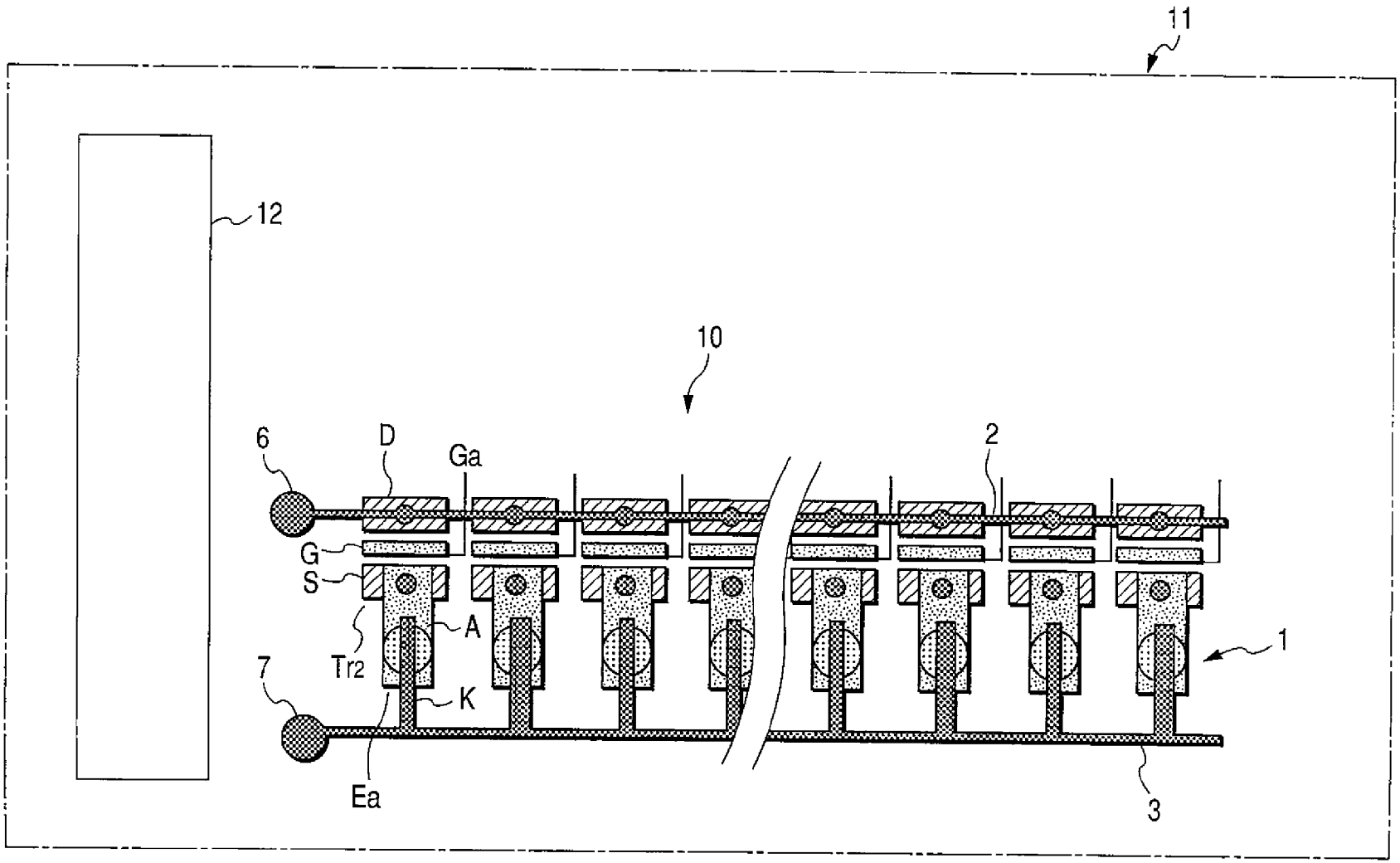
FIG. 34 is a diagram illustrating a configuration of a related example.

FIG. 5 is a diagram illustrating partially around a light-emitting portion in the line head of the present invention. In the configuration of FIG. 5, positions of feeding points are omitted. The connection configuration of first and second power supply lines to the organic EL element Ea is basically the same as the connection configuration of the first and second power supply lines to the organic EL element Ea as shown in FIG. 34. Meanwhile, in FIG. 34, the feeding points of the power supply lines 2 and 3 are formed at the same end portion of the line. To the contrary, in the present invention, one feeding point 6 and another feeding point 7 of the first and second power supply lines 2 and 3 are respectively positioned at opposite sides of the line, as shown in FIG. 2.

Figure 1:
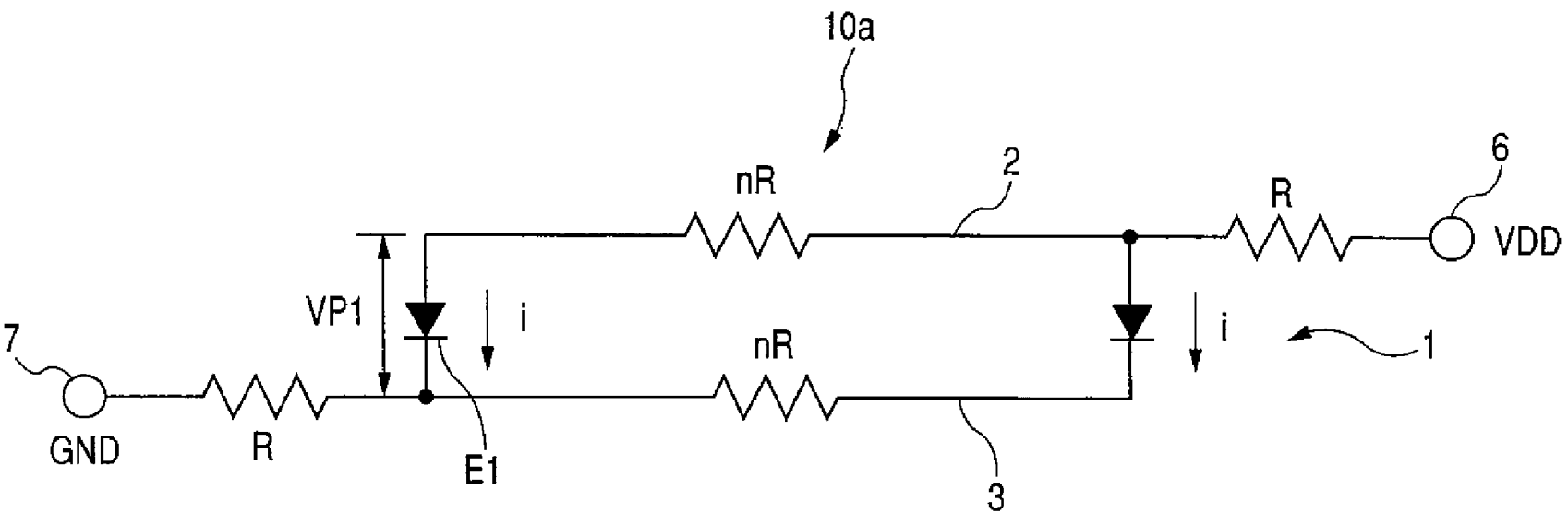
FIG. 1 is a circuit diagram showing an embodiment of the present invention.
Figure 36:
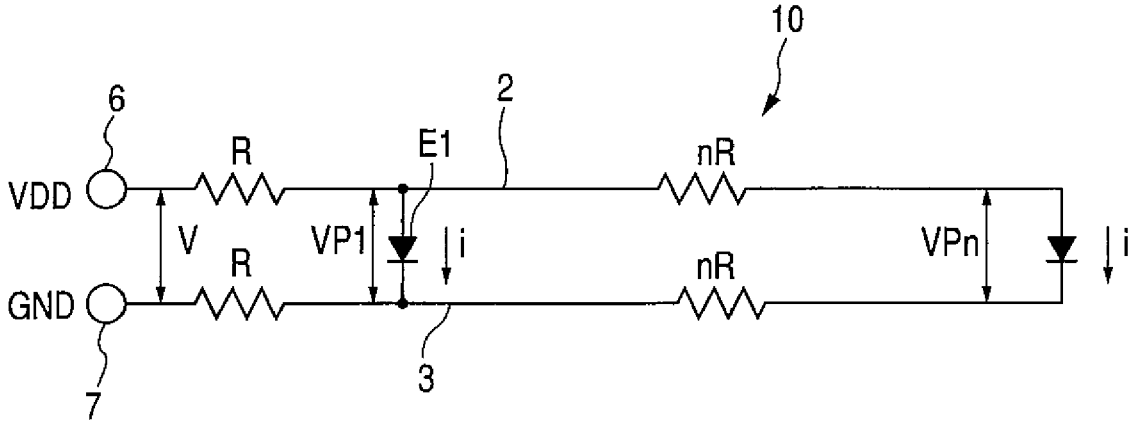
FIG. 36 is a circuit diagram showing the configuration of the related example.

FIG. 1 is a circuit diagram showing an embodiment of the present invention. The same reference numerals as those of FIG. 36 represent the same elements. In FIG. 1, the feeding point 6 of the first power supply line 2 and the feeding point 7 of the second power supply line 3 in the line head 10*a* are formed to be positioned at the opposite sides of the line respectively. In this case, a voltage Vp1 to be applied to a left end light-emitting element E1 satisfies the expression of Vp1=V−4Ri−nRi. Further, a voltage Vpn to be applied to a right end light-emitting element En satisfies Vpn=V−4Ri−nRi.

That is, in the example of FIG. 1, the voltage Vp1 to be applied to the left end light-emitting element E1 and the voltage Vpn to be applied to the right end light-emitting element En are the same. For this reason, the amount of light emitted from the light-emitting elements arranged in a line become equal, such that unevenness of the life spans of the light-emitting elements is not caused. Further, it is possible to improve printing quality.

Figure 2:
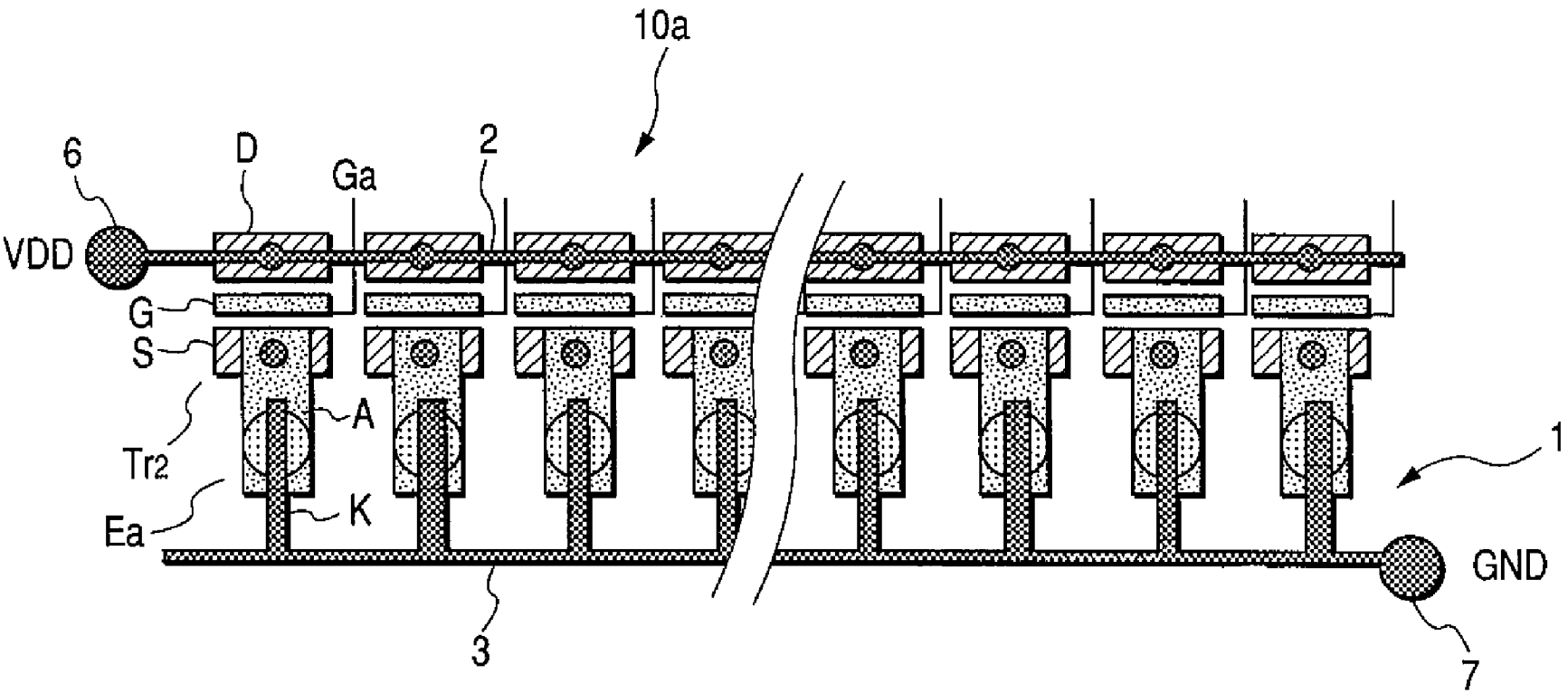
FIG. 2 is a diagram illustrating schematically the embodiment of the present invention.

FIG. 2 is a diagram illustrating schematically the positions of the feeding points of the power supply lines to be connected to the light-emitting elements in the line head 10*a* of the present invention shown in FIG. 1. As shown in FIG. 2, in the present invention, the plurality of light-emitting elements Ea are arranged in a line and the respective light-emitting elements Ea are connected between the first power supply line 2 which is connected to the feeding point 6 of the power supply (VDD) side and the second power supply line 3 which is connected to the feeding point 7 of the ground (GND) side. Further, one feeding point 6 and another feeding point 7 are provided at the opposite sides of the line. Moreover, as the light-emitting element Ea, other than the organic EL element, for example, an LED (light emitting diode) may be used. Since the organic EL element can be statically controlled, it has an advantage in that a control system can be simplified. Further, in case of the LED, the manufacture of the light-emitting element is simplified.

Figure 7:
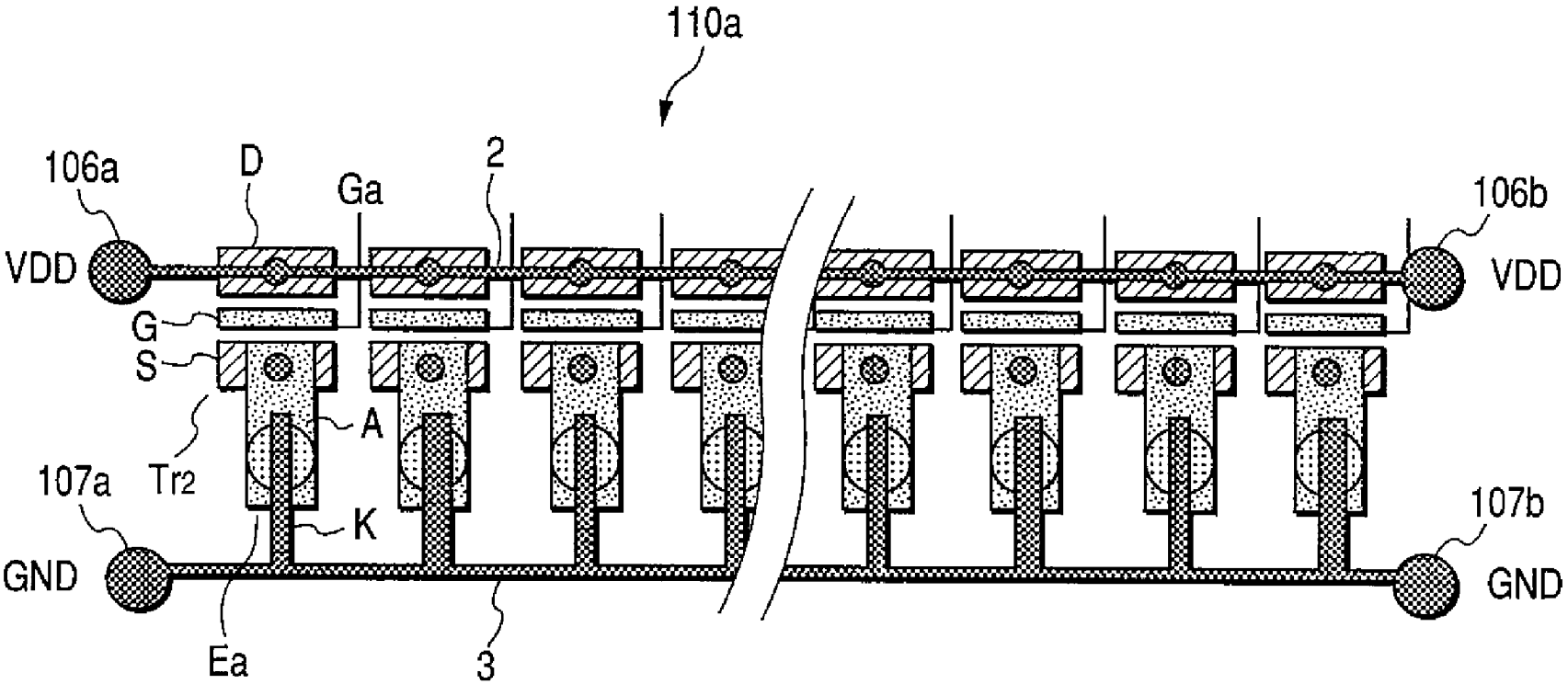
FIG. 7 is a diagram illustrating an another embodiment of the present invention.

In the present invention, as shown in FIG. 7, feeding points 106*a* and 106*b* connected to the first power supply line 2 and feeding points 107*a* and 107*b* connected to the second power supply line 3 in the first and second power supply lines 2 and 3 are respectively positioned at both ends of the line.

Figure 6:
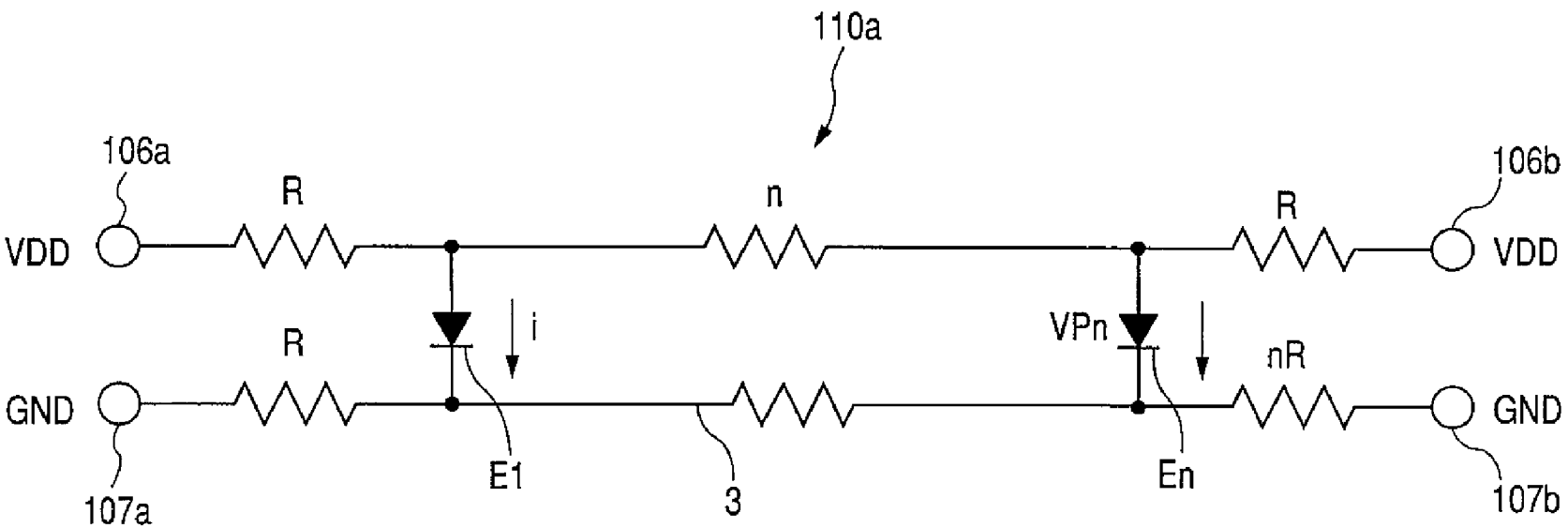
FIG. 6 is a diagram illustrating an another embodiment of the present invention.

FIG. 6 is a circuit diagram showing an embodiment of the present invention. The same reference numerals as those of FIG. 36 represent the same elements. In FIG. 6, the feeding points 106*a* and 106*b* of the first power supply line 2 and the feeding points 107*a* and 107*b* of the second power supply line 3 in the line head 100*a* are formed at the both ends of the line respectively. That is, the four feeding points are formed at both ends of the line. In this case, a voltage Vp1 to be applied to a left end light-emitting element E1 satisfies the expression of Vp1=V−nRi. Further, a voltage Vpn to be applied to a right end light-emitting element En satisfies Vpn=V−nRi.

That is, in the example of FIG. 6, the voltage Vp1 to be applied to the left end light-emitting element E1 and the voltage Vpn to be applied to the right end light-emitting element En are the same. Further, the voltage drops of the power supply lines are one-fourth times as those of the related example in FIG. 36, and then influences on the respective light-emitting elements by the voltage drops of the power supply lines can be reduced. For this reason, the amount of light emitted from the light-emitting elements arranged in a line become equal, such that unevenness of the life spans of the light-emitting elements is not caused. Further, it is possible to improve printing quality.

FIG. 7 is a diagram illustrating schematically the positions of the feeding points of the power supply lines to be connected to the light-emitting elements in the line head 110*a* of the present invention shown in FIG. 6. As shown in FIG. 7, in the present invention, the plurality of light-emitting elements Ea are arranged in a line and the respective light-emitting elements Ea are connected between the first power supply line 2 which is connected to the feeding points 106*a* and 106*b* of the power supply (VDD) side and the second power supply line 3 which is connected to the feeding points 107*a* and 107*b* of the ground (GND) side. Further, the feeding points 106*a* and 106*b* and the feeding points 107*a* and 107*b* are positioned at both ends of the line. Moreover, as the light-emitting element Ea, other than the organic EL element, for example, an LED (light emitting diode) may be used. Since the organic EL element can be statically controlled, it has an advantage in that a control system can be simplified. Further, in case of the LED, the manufacture of the light-emitting element is simplified.

Figure 9:
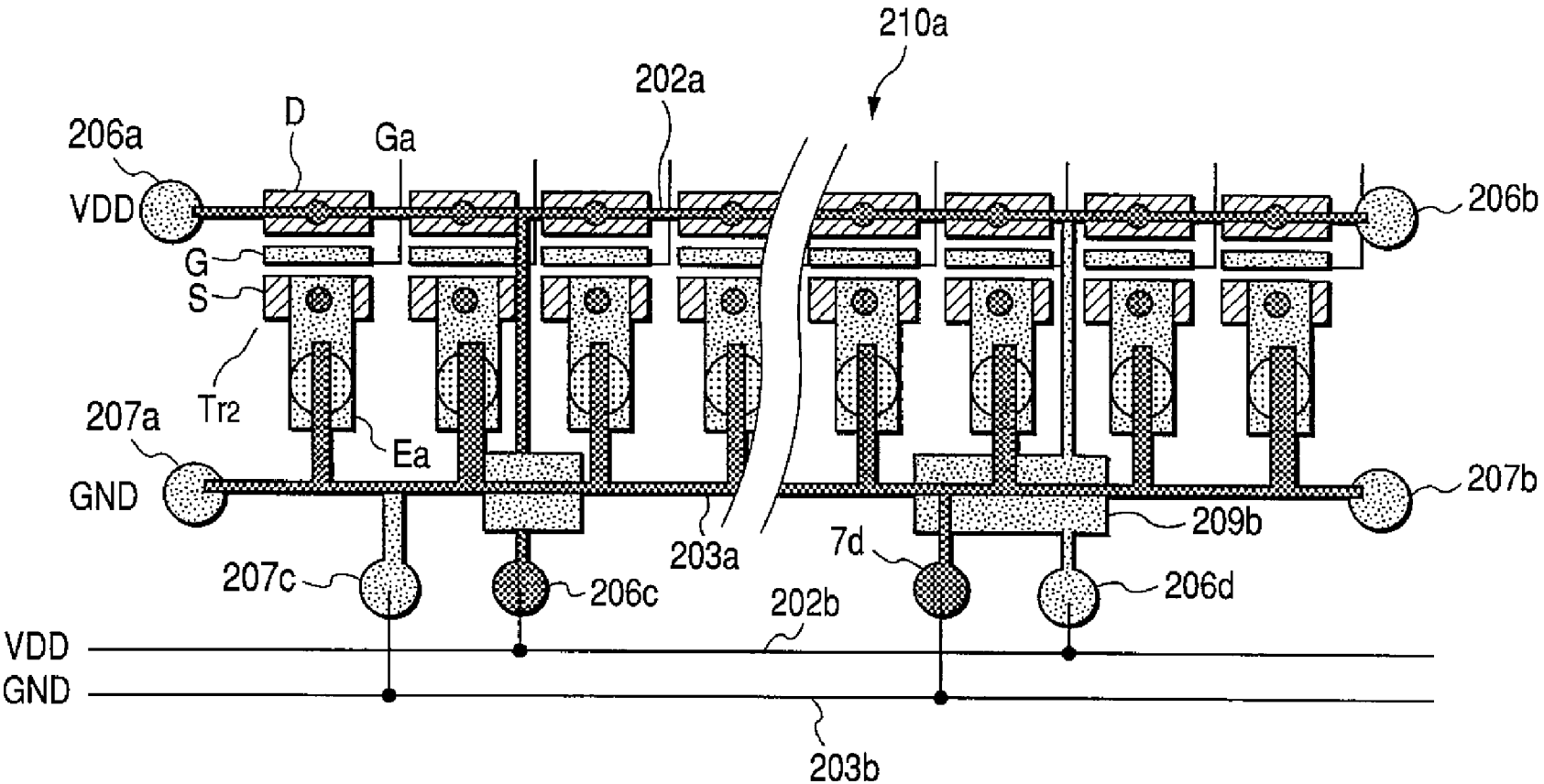
FIG. 9 is a longitudinal cross-sectional side view of an image forming device showing another embodiment of the present invention.

In an another embodiment of the present invention, as shown in FIG. 9, a plurality of feeding points are arranged.

Figure 8:
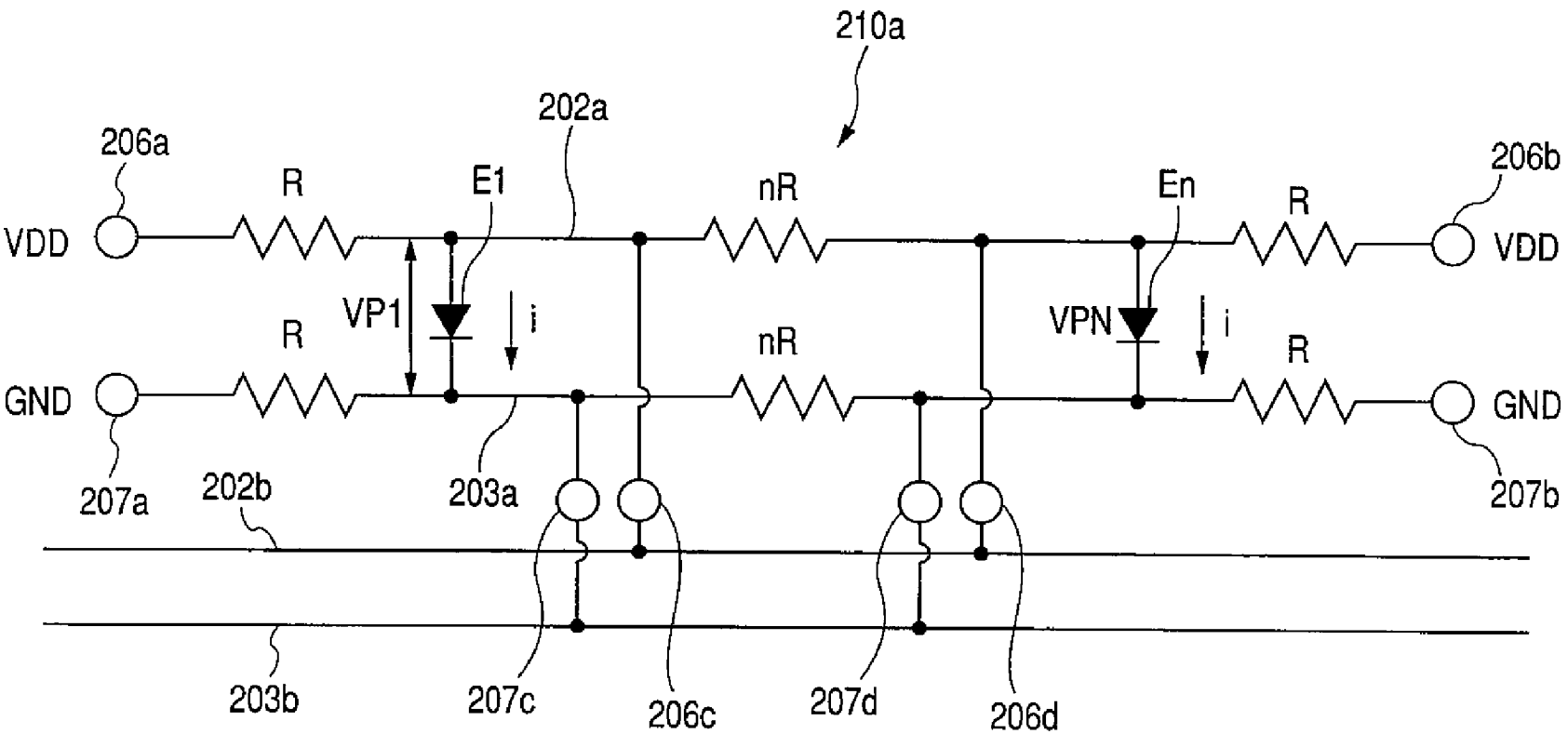
FIG. 8 is a longitudinal cross-sectional side view showing a schematic configuration of a tandem type image forming device of the present invention.

FIG. 8 is a circuit diagram showing an embodiment of the present invention. The same reference numerals as those of FIG. 36 represent the same elements. In FIG. 8, first feeding points 206*a* and 206*b* of the first power supply line 202*a* and first feeding points 207*a* and 207*b* of the second power supply line 203*a* in a line head 210*a* are positioned at both ends of a line. Further, a third power supply line 202*b* of the power supply side and a fourth power supply line 203*b* of the ground side are formed along a lengthwise direction of the line.

In the third power supply line 202*b* of the power supply side and the fourth power supply line 203*b* of the ground side, feeding points are respectively provided. In the third power supply line 202*b* of the power supply side, second feeding points 206*c* and 206*d* are provided. Further, in the fourth power supply line 203*b* of the ground side, second feeding points 207*c* and 207*d* are provided. The second feeding points 206*c* and 206*d* of the power supply side are connected to the first power supply line 202*a*. In addition, the second feeding points 207*c* and 207*d* of the ground side are connected to the second power supply line 203*a*. Moreover, the first power supply line 202*a* of the power supply side and the third power supply line 202*b* may be connected to the same power supply or they may be connected to different power supplies.

As described above, in the example of FIG. 8, since the number of the feeding points of the power supply lines increases, it is possible to suppress influences on the respective light-emitting elements by the changes in voltage. For this reason, the amount of light emitted from the light-emitting elements arranged in a line can be equalized, and unevenness of the life spans of the light-emitting elements is not caused. Further, it is possible to improve printing quality. Moreover, in FIG. 8, similarly to FIG. 36, the first feeding points may be provided only at one end portion of the line.

Further, in FIG. 8, two second feeding points are provided at the power supply side and the ground side, but one second feeding point may be provided. In addition, the second feeding points are not needed to be set at the power supply side and the ground side in the same number and at the same positions. The different number of second feeding points may be provided at different positions of the power supply side and the ground side, for example, in a cross-stitch shape. In such a manner, the positions or the number of the second feeding points may be set arbitrarily. Moreover, the second feeding points may be provided around the first feeding points 206*a*, 207*a*, 206*b* and 207*b* which are provided at both ends of the line shown in FIG. 8. In this case, the second feeding points are respectively connected to the first power supply line 202*a* of the power supply side and the second power supply line 203*a* of the ground side. In such a manner, since the second feeding points are arranged, influences by the voltage drops of the power supply lines can be reduced. For this reason, the difference between the voltages to be applied to the light-emitting elements can be removed, and thus it is possible to equalize the amount of emitted light.

FIG. 9 is a diagram illustrating schematically the positions of the feeding points of the power supply lines to be connected to the light-emitting elements in the line head 210*a* of the present invention shown in FIG. 8. As shown in FIG. 9, in the embodiment of the present invention, the plurality of light-emitting elements Ea are arranged in a line and the respective light-emitting elements Ea are connected between the first power supply line 202*a* which is connected to the feeding points 206*a* and 206*b* of the power supply (VDD) side and the second power supply line 203*a* which is connected to the feeding points 207*a* and 207*b* of the ground (GND) side. Further, the feeding points 206*a* and 206*b* and the feeding points 207*a* and 207*b* are respectively-provided at both ends of the line.

Further, the third power supply line 202*b* of the power supply side and the fourth power supply line 203*b* of the ground side are arranged along the lengthwise direction of the line. To the third power supply line 202*b* and the fourth power supply line 203*b*, the plurality of second feeding points 206*c*, 206*d*, 207*c* and 207*d* are respectively connected. The second feeding points 206*c*, 206*d*, 207*c* and 207*d* are connected to the first power supply line 202*a* and the second power supply line 203*a*. Reference numerals 209*a* and 209*b* denote insulating portions which are provided at portions at which connecting portions of the second feeding points 206*c* and 206*d* with the first power supply line 202*a* intersect the second power supply line 203*a*.

Moreover, as the light-emitting element Ea, other than the organic EL element, for example, an LED (light emitting diode) may be used. Since the organic EL element can be statically controlled, it has an advantage in that a control system can be simplified. Further, in case of the LED, the manufacture of the light-emitting element is simplified.

In an another embodiment of the present invention, one feeding point 6 and another feeding point 7 in the first and second power supply lines 2 and 3 are provided at various positions with respect to the power supply lines, as described below.

Figure 10A:
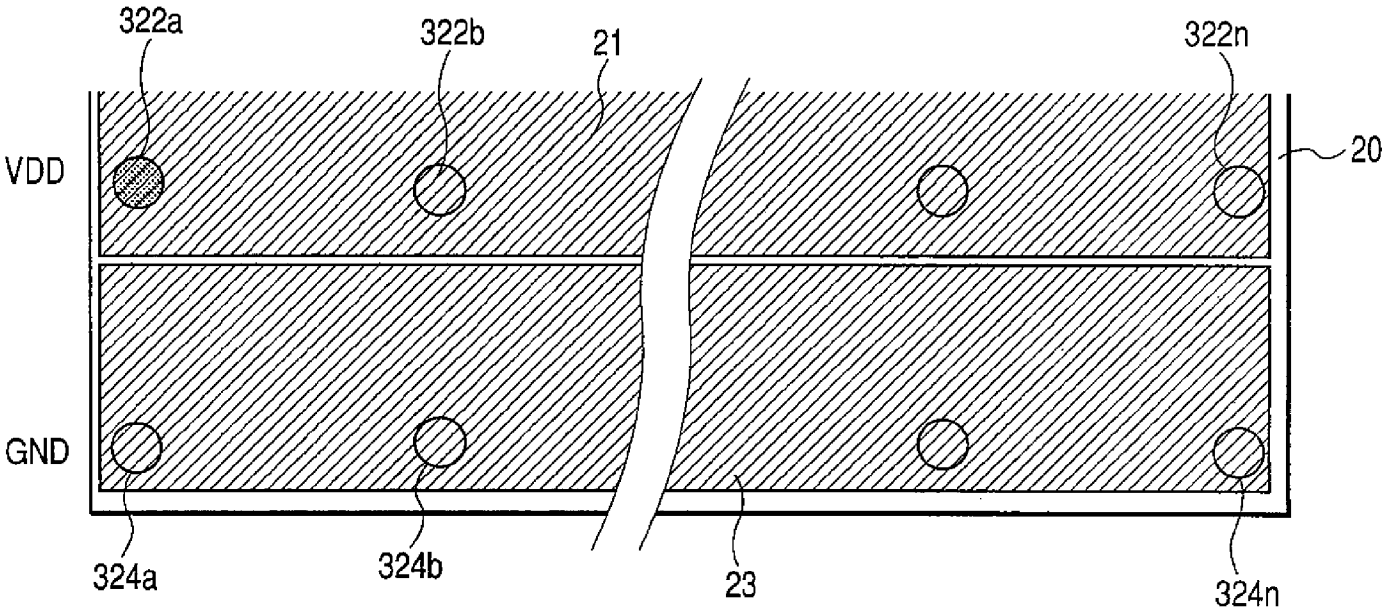
FIG. 10 is a diagram illustrating an another embodiment of the present invention.
Figure 10B:
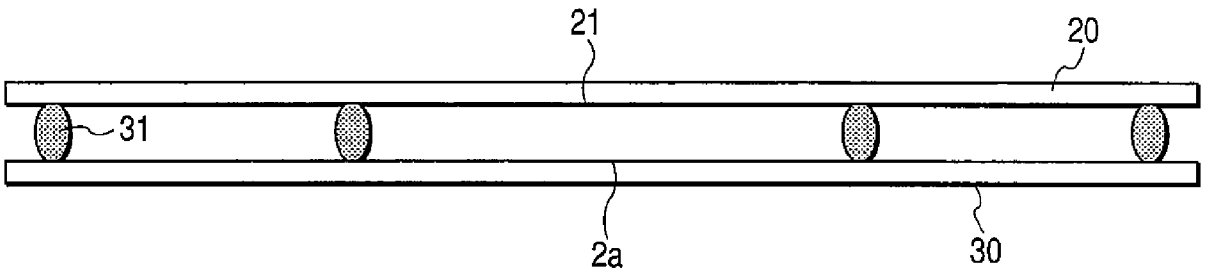

FIGS. 10A and 10B are diagrams illustrating an embodiment of the present invention. FIG. 10A is a plan view and FIG. 10B is a side view. In FIGS. 10A and 10B, a reference numeral 30 denotes a substrate, a reference numeral 302*a* denotes a power supply line which is arranged on the substrate, a reference numeral 20 denotes a moisture-proof plate, and reference numerals 21 and 23 denote auxiliary power supply lines which are arranged at a lower side of the moisture-proof plate 20. The moisture-proof plate 20 is intended to protect organic EL elements which are formed on the substrate 30. Moreover, at a power supply (VDD) side and a ground (GND) side on the substrate, power supply lines are respectively formed.

The auxiliary power supply line 21 is arranged at the power supply (VDD) side, and the auxiliary power supply line 23 is arranged at the ground (GND) side. Reference numerals 322*a* to 322*n* denote feeding points of the auxiliary power supply line 21, and reference numerals 24*a* to 24*n* denote feeding points of the auxiliary power supply line 23. The respective feeding points 322*a* to 322*n* and 324*a* to 324*n* which are formed on the moisture-proof plate 20 are electrically connected to the respective feeding points of the power supply lines arranged on the substrate 30 by connecting member 31.

As described above, in a configuration of FIGS. 10A and 10B, since the number of the feeding points increases, it is possible to suppress influences on the light-emitting elements, which are arranged for every line, by changes in voltage of the power supply lines. Therefore, it is possible to equalize the amount of light emitted from the light-emitting elements which are arranged in a line. As the connecting member 31, for example, an adhesive made of conductive particles may be used. In such a manner, since the connecting member 31 is comprised of the adhesive, it is possible to strength the connections between the respective feeding points of the power supply lines and the respective feeding points of the auxiliary power supply lines.

The power supply line of the power supply (VDD) side which is arranged on the substrate 30 is covered with a partition material. For this reason, for example, by forming a contact hole and inserting the connecting member 31 into the contact hole, it is possible to electrically connect the feeding points on the substrate 30 and the feeding points on the moisture-proof plate 20. In the example of FIG. 10, since the auxiliary power supply lines 21 and 23 are arranged in the moisture-proof plate 20 which is originally comprised of a blank space without providing a member, it is possible to use efficiently a space.

Further, a plurality of feeding points 322*a* to 322*n* and 324*a* to 324*n* are provided in the moisture-proof plate 20 and electrically connected to the respective feeding points on the substrate 30 by the connecting member 31. For this reason, influences on the respective light-emitting elements by the changes in voltage of the power supply lines are suppressed, and the amount of emitted light make be equalized. Further, the auxiliary power supply lines 21 and 23 are formed on the moisture-proof plate 20 at a large width in a planar shape. For this reason, it is possible to lower the resistance values. In addition, for example, if the auxiliary power supply lines 21 and 23 are formed with non-transparent materials, it is possible to prevent lost light from being emitted from the light-emitting elements in an opposite direction to the image carrier.

Figure 11:
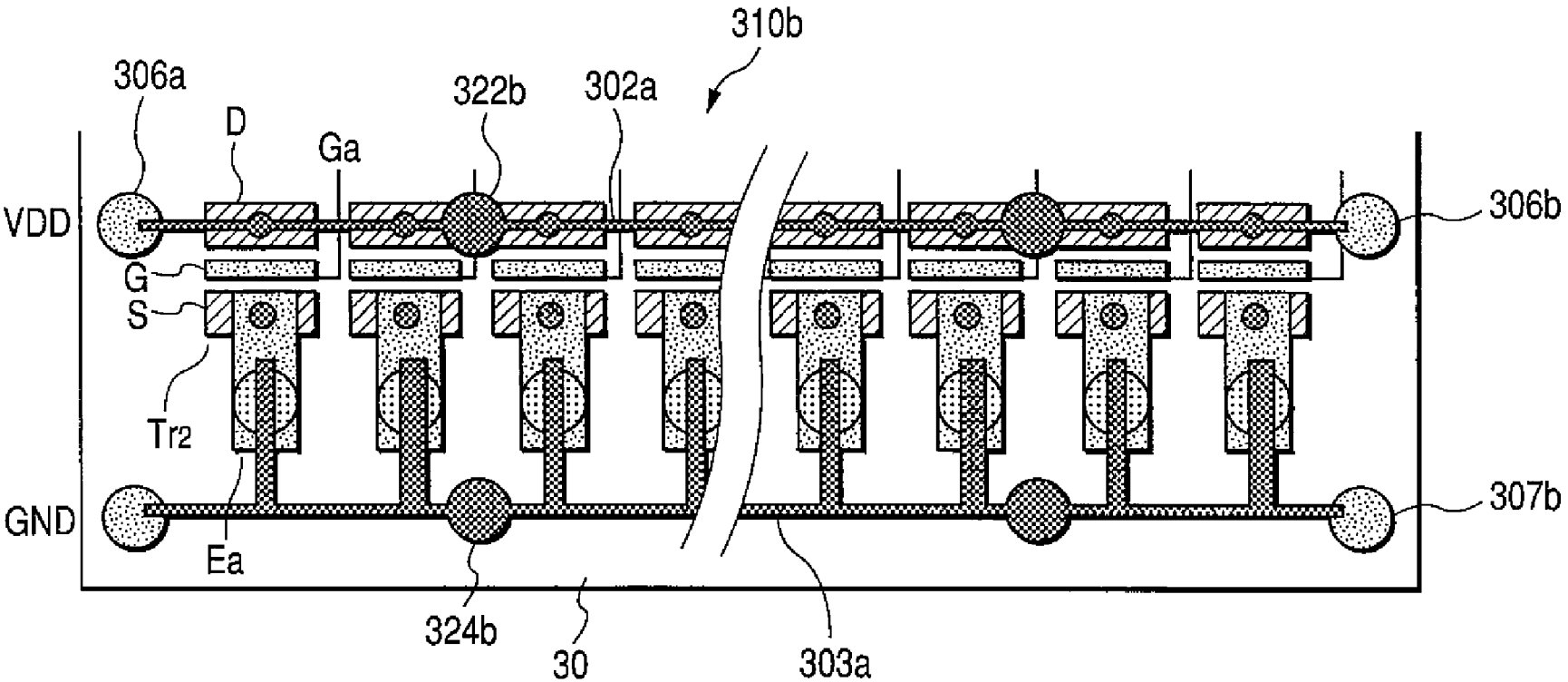
FIG. 11 is a diagram illustrating an another embodiment of the present invention.
Figure 17:
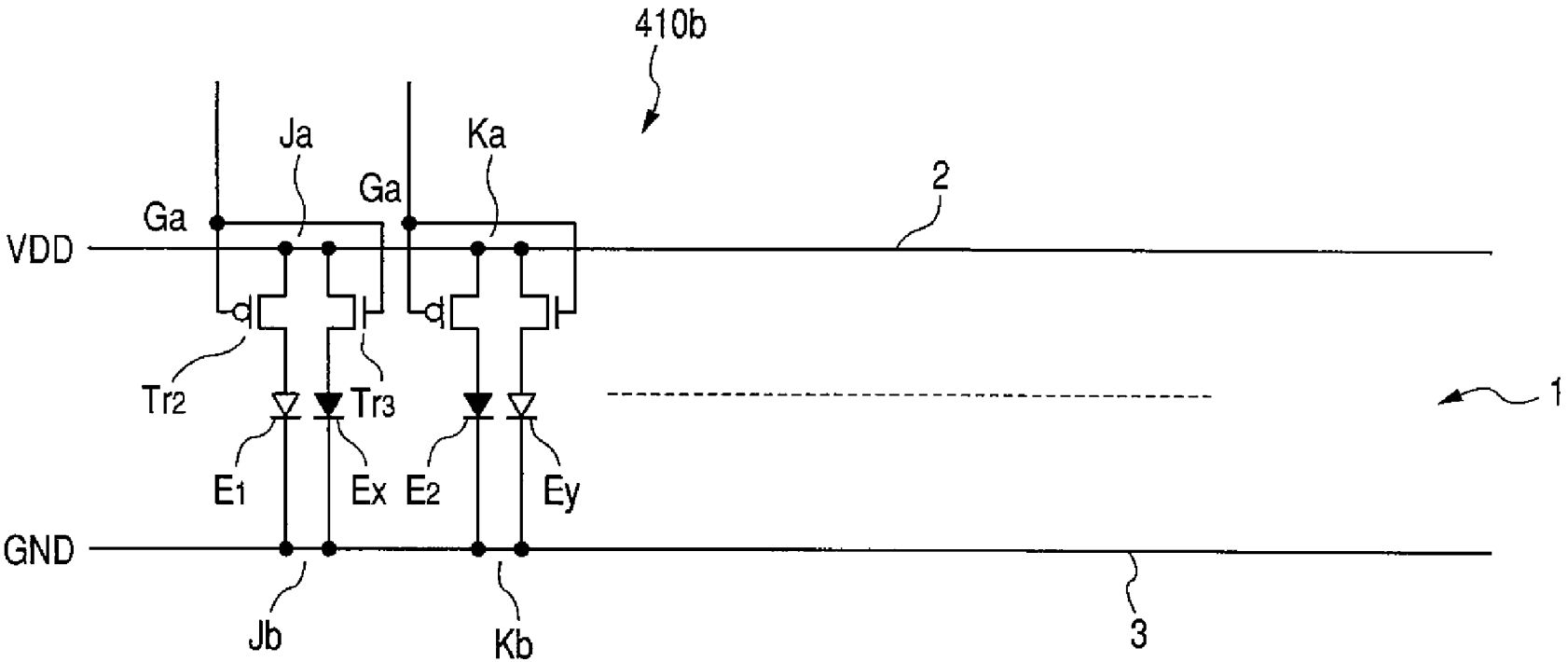
FIG. 17 is a diagram illustrating an another embodiment of the present invention.

FIG. 11 is a diagram illustrating a configuration of a substrate side of a line head 310*b* according to an embodiment of the present invention. The same reference numerals as those of FIG. 17 represent the same elements. In FIG. 11, the feeding points 306*a* and 306*b* of the power supply (VDD) side and the feeding points 307*a* and 307*b* of the ground (GND) side are provided at both ends of the line. Further, in the power supply line 302*a* of the power supply (VDD) side, feeding points 322*a* to 322*m* are provided at positions which correspond to the feeding points formed on the moisture-proof plate 20. In addition, feeding points 324*a* to 324*m* are provided at positions which correspond to the feeding points of the ground (GND) side.

Moreover, the feeding points 322*a* and 322*n* of the auxiliary power supply line 21 which are formed on the moisture-proof plate 20 correspond to the feeding points 306*a* and 306*b* of the power supply (VDD) side which are formed on the substrate 30. Further, the feeding points 324*a* and 324*n* of the auxiliary power supply line 23 which are formed on the moisture-proof plate 20 correspond to the feeding points 307*a* and 307*b* of the ground (GND) side which are formed on the substrate 30.

Figure 12A:
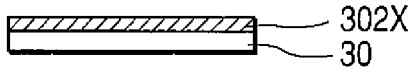
FIG. 12 is a diagram illustrating an another embodiment of the present invention.
Figure 12B:
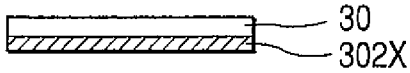
Figure 12C:
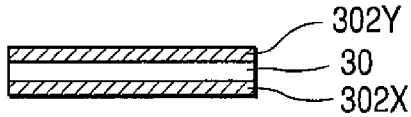
Figure 12D:
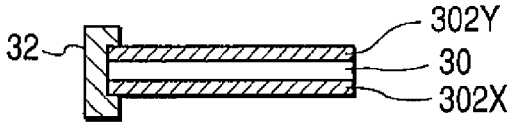

FIGS. 12A to 12D are diagrams illustrating a configuration of a substrate side according to an embodiment of the present invention. In FIG. 12A, an auxiliary power supply line 302*x* is formed with a thin film on one surface of the substrate 30. In FIG. 12B, the substrate 30 is inverted. In FIG. 12C, a power supply line 302*y* is formed with a thin film on the other surface of the substrate 30. In FIG. 12D, the power supply line 302*y* and the auxiliary power supply line 302*x* are electrically connected to each other at an end portion of the substrate 30 by a connecting member 32.

In FIGS. 12A to 12D, since the power supply line 302*y* and the auxiliary power supply line 302*x* are connected in parallel by the connecting member 32, it is possible to lower the resistance value. Accordingly, in the example of FIGS. 12A to 12D, the auxiliary power supply line 302*x* is formed to lower the resistance value of the power supply line 302*y*. Thus, influences on the respective light-emitting elements by the change in voltage of the power supply line are suppressed, and further the amount of emitted light are equalized.

As shown in FIG. 12D, the auxiliary power supply line is formed at a lower side of the substrate, that is, in a direction of an image carrier. In this situation, the auxiliary power supply lines are formed in portions other than positions at which light emitted from the light-emitting elements is emitted toward the image carrier, such that exposure is not obstructed. Moreover, the auxiliary power supply line 302*x* is formed in a planar shape with non-transparent material, similar to the auxiliary power supply lines 21 and 23 which are formed at a lower side of the moisture-proof plate 20 of FIG. 10. Thus, it is possible to prevent light emitted from the light-emitting elements from leaking in a different direction from the direction of the image carrier as lost light.

In the example of FIGS. 12A to 12D, since the thin film power supply lines and the thin film auxiliary power supply lines are formed on both sides of the substrate 30, tensions by the thin film conductive members on both sides of the substrate are competed. For this reason, a curve of the substrate is suppressed, as compared to the case in which the power supply lines are formed with the thin films on one side of the substrate. Therefore, the film thicknesses of the thin films can be made larger to lower the resistance values, and influences on the light-emitting elements by the changed in voltage can be reduced. Further, the power supply lines and the auxiliary power supply lines are connected in parallel on both sides of the substrate, and thus it is possible to reduce the resistance values.

Figure 13:
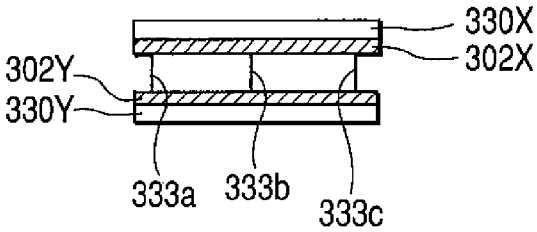
FIG. 13 is a diagram illustrating an another embodiment of the present invention.

FIG. 13 is a diagram illustrating another embodiment of the present invention. In FIG. 13, an auxiliary power supply line 302*x* is formed on a substrate 330*x*. Further, a power supply line 302*y* is formed on a substrate 330*y*. Both substrates 330*x* and 330*y* are arranged opposite to each other such that the sides on which the power supply lines are formed to face each other. In the auxiliary power supply line 302*x* and the power supply line 302*y*, a plurality of feeding points are provided, and the respective feeding points are connected to each other by connecting lines 333*a*, 333*b*, and 333*c*. In the example of FIG. 13, the auxiliary power supply line 302*x* is formed in the same pattern as that of the power supply line 302*y*.

Therefore, if the power supply line 302*y* is formed in a linear pattern, the auxiliary power supply line 302*x* is also formed in a linear pattern. For this reason, it is easy to manufacture the auxiliary power supply line 302*x*. As the connecting lines 333*a*, 333*b*, and 333*c*, adhesives made of conductive particles as described in FIG. 10B may be used. In the example of FIG. 13, the number of the feeding points increases, and then it is possible to reduce influences on the light-emitting elements by the changes in voltage of the power supply lines.

Figure 14:
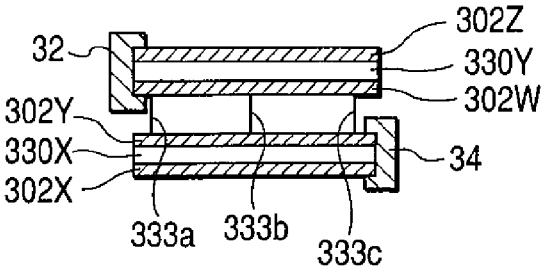
FIG. 14 is a diagram illustrating an another embodiment of the present invention.

FIG. 14 is a diagram illustrating another embodiment of the present invention. In FIG. 14, a power supply line 302*y* and an auxiliary power supply line 302*x* are formed on both sides of a substrate 330*x*, and the power supply line 302*y* and the auxiliary power supply line 302*x* are electrically connected to each other at an end of the substrate 330*x* by a connecting member 34. Further, a power supply line 302*w* and an auxiliary power supply line 302*z* are formed on both sides of a substrate 330*y*, and the power supply line 302*w* and the auxiliary power supply line 302*z* are electrically connected to each other at an end of the substrate 330*y* by a connecting member 32.

In the example of FIG. 14, similar to FIG. 12D, since the power supply lines and the auxiliary power supply lines are connected in parallel to each other on both sides of the respective substrates, it is possible to reduce the resistance values. For this reason, influences on the respective light-emitting elements by the changes in voltage of the power supply lines are suppressed and the amount of emitted light make be equalized. In the embodiment of the present invention, as shown in FIG. 14, a combination of the configurations in FIG. 12D and FIG. 13 may be implemented.

Figure 15:
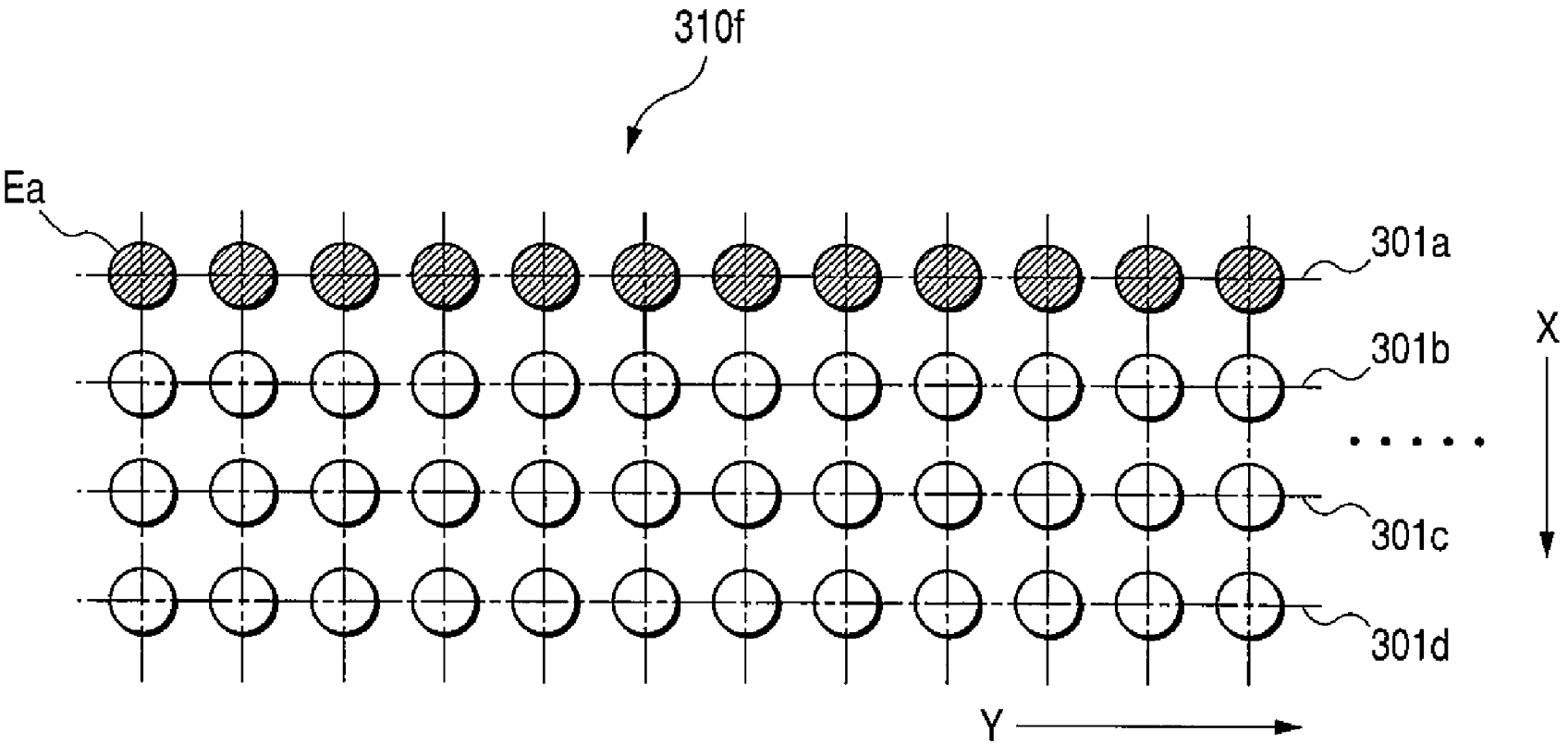
FIG. 15 is a diagram illustrating an another embodiment of the present invention.

FIG. 15 is a diagram illustrating a line head 310*f* according to another embodiment of the present invention. In FIG. 15, in the line head 310*f*, a light-emitting element line 301*a* in which a plurality of light-emitting elements Ea are arranged in a main scanning direction (Y direction) is provided. Here, in particular, a plurality of the light-emitting element lines are formed in a sub-scanning direction (X direction). In this example, four lines 301*a*, 301*b*, 301*c* and 301*d* are provided.

In the example of FIG. 15, the light-emitting element line 1*b* is formed as a light-emitting element line provided for a preliminary operation and is normally not used. In the case in which any one of the light-emitting elements Ea in the light-emitting element line 301*a* for the normal operation which is used for a normal printing processing is defective, the light-emitting element line 301*b* for the preliminary operation is used by the switch which is described below in detail. The light-emitting element lines 301*c* and 301*d* may be used, for example, in case of performing multi-exposure.

In the line head of the present invention, the light-emitting element line provided for the preliminary operation is not limited to one line. The light-emitting element line 301*c* may be formed for the preliminary operation of the light-emitting element line 301*d*. Further, in the example of FIG. 15, the four light-emitting element lines are formed in the sub-scanning direction, but the two light-emitting element lines may be formed, such that one line as the light-emitting element line for the normal operation and another line as the light-emitting element line for the preliminary operation can be selected. Moreover, in the line head for the multi-exposure, the arbitrary number of light-emitting element lines for the normal operation may be formed.

As described above, in the present invention, two or more light-emitting element lines may be formed in the sub-scanning direction of the line head, and at least one line among them may be formed as the light-emitting element line for the preliminary operation. As an example, as described above, in the case in which the two light-emitting element lines are divided into the light-emitting element line for the normal operation and the light-emitting element line for the preliminary operation, three or more light-emitting element lines may be formed, and at least one line among them may be used as the light-emitting element line for the preliminary operation. In the latter, two or more light-emitting element lines for the preliminary operation may be formed.

Figure 16:
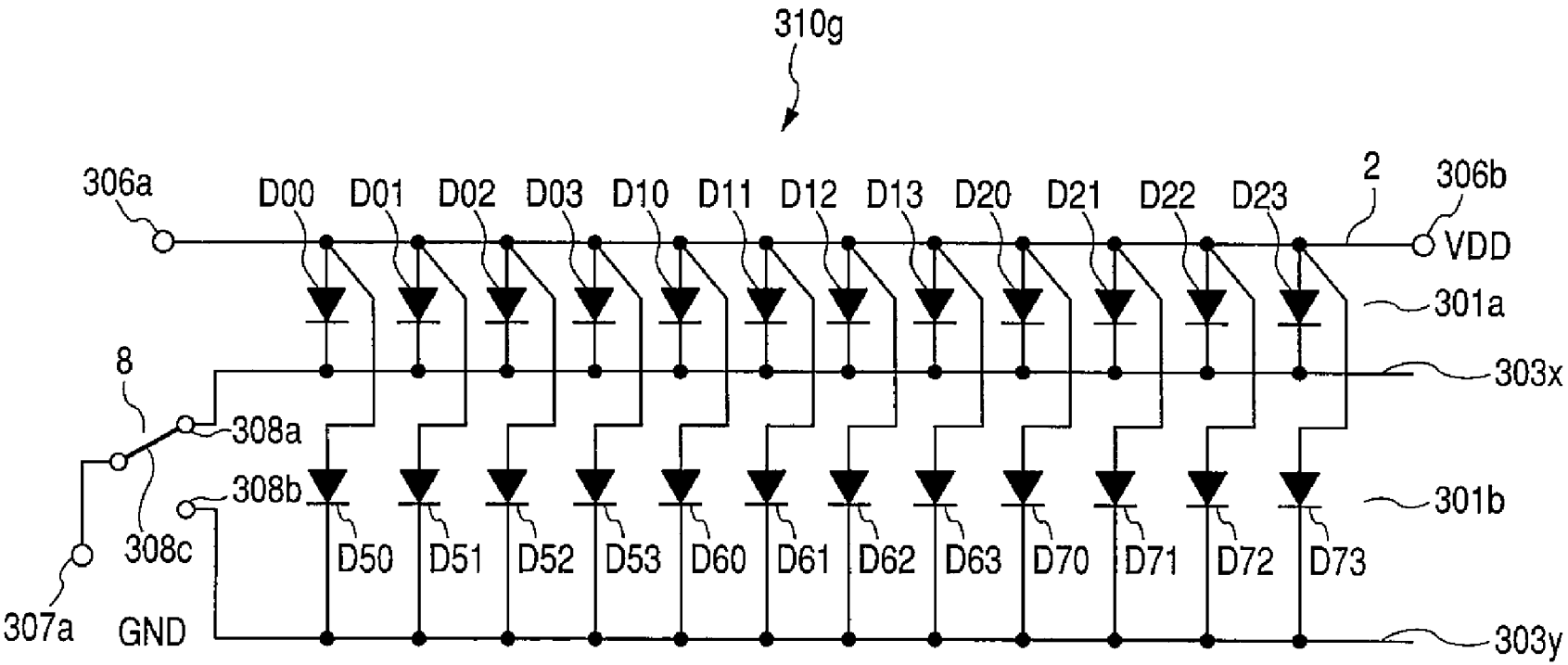
FIG. 16 is a diagram illustrating an another embodiment of the present invention.

FIG. 16 is a circuit diagram showing another embodiment of the present invention. In a line head 310*g*, the light-emitting element lines 301*a* and 301*b* are formed. In the light-emitting element line 301*a*, for example, the light-emitting elements D00 to D23 which use the organic EL elements are arranged. Further, in the light-emitting element line 1*b*, the light-emitting elements D50 to D73 which use the organic EL elements are also arranged. A reference numeral 2 denotes a first power supply line which is connected to the feeding points 306*a* and 306*b* of the power supply (VDD) side, and reference numerals 303*x* and 303*y* denote second power supply lines which are connected to the feeding points 307*a* and 307*b* (the reference numeral 307*b* is not shown) of the ground (GND) side.

A reference numeral 8 denotes a switch, and, in the case in which the contactor 308*c* is connected to a contact 308*a*, a direct current (DC) voltage is applied between the power supply lines 2 and 303*x*, such that the respective light-emitting elements D00 to D23 of the light-emitting element line 301*a* are turned on. Further, in the case in which the contactor 308*c* of the switch 8 is connected to a contact 308*b*, a DC voltage is applied between the power supply lines 2 and 303*y*, such that the respective light-emitting elements D50 to D73 of the light-emitting element line 301*b* are turned on.

The light-emitting element line 1*a* is used for the normal operation, and the light-emitting element line 301*b* is provided for the preliminary operation. If any one of the light-emitting elements D00 to D23 of the light-emitting element line 1*a* is defective, a voltage is applied to the respective light-emitting elements D50 to D73 of the light-emitting element line 1*b* by the switch 8, such that the light-emitting elements D50 to D73 emit light. As described above, in the example of FIG. 7, by switching the power supply lines 303*x* and 303*y* which are commonly connected to the cathode sides of the light-emitting elements of the respective light-emitting element line, the light-emitting element lines are switched.

In this situation, the first power supply line 2 is commonly connected to the anode electrodes of the light-emitting elements of the respective light-emitting element lines. In the example of FIG. 16, one power supply line 2 is to be commonly connected to the two light-emitting element lines, and other power supply lines 303*x* and 303*y* are only switched. For this reason, as compared to the case in which both power supply lines are switched, it is possible to simply the configuration of the switch. Further, it is possible to smoothly perform the switching operation.

As the switch 8, other than a mechanical switch as shown in FIG. 16, an electronic switch such as a transistor may be used. Further, one of the light-emitting element lines 301*a* and 301*b* may be used for the normal operation and another may be used for the preliminary operation. That is, the light-emitting element line 301*b* may be used for the normal operation and the light-emitting element line 301*a* may be used for the preliminary operation. Moreover, in the case in which the switch is comprised of a switching transistor, the switching between the light-emitting element lines can be performed precisely and immediately.

In an another embodiment of the present invention, one feeding point 6 and the other feeding point 7 in first and second power supply lines 2 and 3 may be provided at various positions to a line, as described below.

Figure 35:
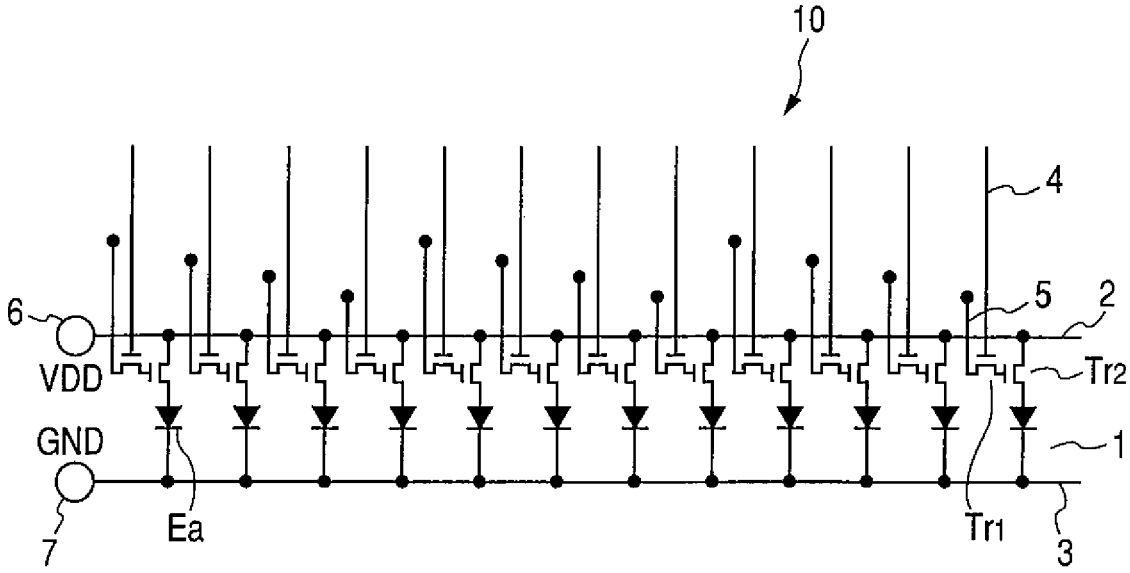
FIG. 35 is a circuit diagram showing the configuration of the related example.

FIG. 17 is a circuit diagram showing an embodiment of the present invention. The same reference numerals as those of FIG. 35 represent the same elements. In FIG. 17, a line head 410*b* connects light-emitting elements E1, E2 . . . between the first power supply line 2 and the second power supply line 3 to form a light-emitting element line 1. To the light-emitting element E1 which is connected to a connecting portion Ja-Jb between the first power supply line 2 and the second power supply line 3, a dummy light-emitting element Ex is connected in parallel. Further, to the light-emitting element E2 which is connected to a connecting portion Ka-Kb between the first power supply line 2 and the second power supply line 3, a dummy light-emitting element Ey is connected in parallel.

Drive transistors Tr2 of the light-emitting elements E1, E2 . . . are comprised of P-channel transistors, and drive transistors Tr3 of the dummy light-emitting elements Ex, Ey . . . are comprised of N-channel transistors. In such a manner, the drive transistors Tr2 of the light-emitting elements E1, E2 . . . and the drive transistors Tr3 of the dummy light-emitting elements Ex, Ey . . . are comprised of complementary transistors, that is, transistors of which conductive layers have different polarities. If doing so, when the same signal is supplied to the gate line Ga, the light-emitting elements E1, E2 . . . and the light-emitting elements Ex, Ey inversely operate.

For example, if a signal for turning on the drive transistors Tr2 is supplied, the light-emitting elements E1, E2 . . . emit. In this case, the drive transistors Tr3 are turned off, and thus the dummy light-emitting elements Ex, Ey . . . do not emit. Further, when the dummy light-emitting elements Ex, Ey emit, the light-emitting elements E1, E2 . . . do not emit. In such a manner, a pair of drive transistors for controlling the turning-on of the light-emitting elements and the dummy light-emitting elements have conductive layers of different polarities. Thus, it is possible to control the turning-on and -off of both transistors with the same signal. For this reason, the formation of the control signals of the transistors is simplified.

In such a manner, the dummy light-emitting elements which are connected in parallel to the light-emitting elements to be turned off emit by the shapes of the turning-on patterns, and the dummy light-emitting elements which are connected in parallel to the light-emitting elements to be turned on do not emit. For this reason, the total current flowing into the connecting portions between the power supply lines 2 and 3 to which the respective light-emitting elements are connected is constant in any connecting portions. Therefore, irregardless of the light-emitting patterns, the potentials of the power supply lines between the connecting portions to which the respective light-emitting elements are connected do not change. For this reason, irregularity in quantity of emitted light according to the turning-on patterns of the light-emitting elements is not caused. Thus, printing quality is advanced, and unevenness in life span is suppressed.

The dummy light-emitting elements Ex, Ey . . . may be comprised of light-emitting elements having the same characteristic of the light-emitting elements E1, E2 . . . . In this case, in order to prevent light from leaking outside when the dummy light-emitting elements Ex, Ey . . . are turned on, a masking processing is performed. Further, in FIG. 15, the drive transistors Tr2 of the light-emitting elements E1, E2 . . . may be comprised of N-channel transistors and the drive transistors Tr3 of the dummy light-emitting elements Ex, Ey . . . may be comprised of P-channel transistors.

In addition, all the drive transistors Tr2 and Tr3 may be comprised of N-channel transistors or P-channel transistors. That is, the conductive layers of the pair of the transistors may have the same polarity. In this case, the gate lines of the respective drive transistors Tr2 and Tr3 are divided, and signals having different polarities are supplied to the gates of the drive transistors Tr2 and Tr3 such that one transistor is turned on, while another transistor is turned off.

Therefore, by using an inverter, it is possible to allow the light-emitting element E1 and the pseudo light-emitting element Ex to operate complementarily. In this case, since the same signal may be supplied to the respective drains of the control transistors Tr1 of the light-emitting element E1 side and the light-emitting element Ex, the configuration of a control circuit is simplified.

In the configuration described above, since the pseudo light-emitting elements are turned on, it is necessary to shield light of the pseudo light-emitting elements. For this reason, there is a problem in that the configuration of the line head becomes complicated. In order to cope with the above problem, instead of the pseudo light-emitting element, a resistance R may be connected. Here, the resistance value of the resistance R is set such that the same current as that of the light-emitting element E1 flows. The resistance R is formed, for example, by depositing a conductive layer on the same substrate as that of the light-emitting element E1. In this configuration, it has an advantage in that the shielding of light to be emitted from the pseudo load is not needed.

As described above, in the embodiments of the present invention shown in FIG. 17, the pseudo loads such as the pseudo light-emitting elements or the resistances are connected in parallel to the light-emitting elements between the power supply lines. For this reason, the total current flowing into the connecting portions between the power supply lines to which the respective light-emitting elements are connected is constant in any connecting portions. Therefore, influences by the changes in voltage of the power supply lines are removed, and thus it is possible to equalize the amount of emitted light.

Figure 18A:
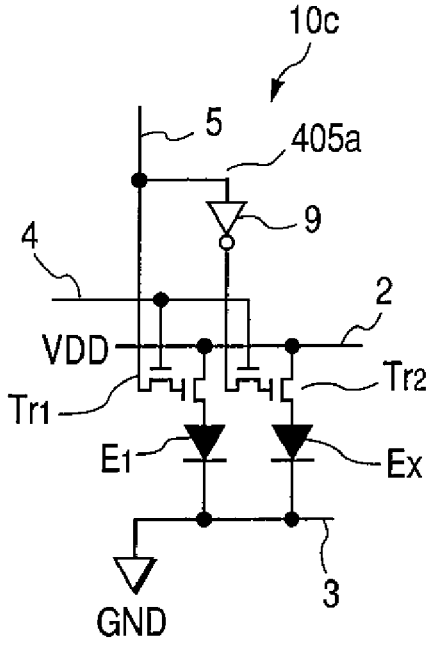
FIG. 18 is a diagram illustrating an another embodiment of the present invention.
Figure 18B:
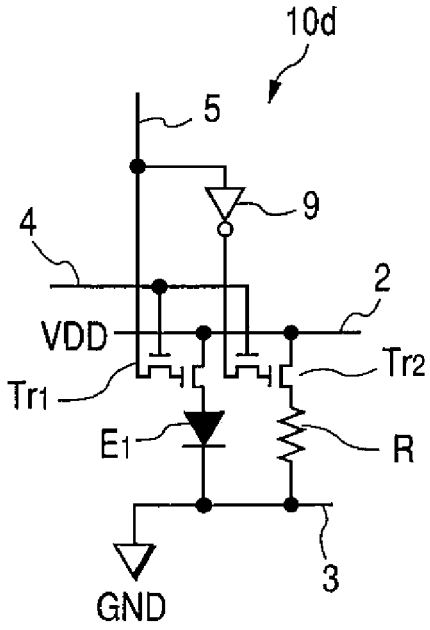

FIGS. 18A and 18B are circuit diagrams showing partially another embodiment of the present invention. In a light-emitting element line 401*y* of a line head 410*c* in FIG. 18A, as described in FIG. 35, in a control transistor Tr1, a signal line 4 of a gate and a signal line 5 of a drain are provided. Further, as described above, a drain of a drive transistor Tr2 is connected to a first power supply line 2, and to the gate thereof, a source of the control transistor Tr1 is connected.

In the control transistor Tr1 of the light-emitting element E1 side, the signal line 5 of the drain is branched off to form a branch line 405*a*. To the branch line 405*a*, an inverter 9 is connected. An output signal of the inverter 9 is supplied to the drain of the control transistor Tr1 of the dummy light-emitting element Ex side. Therefore, by using such an inverter 9, it is possible to allow the light-emitting element E1 and the dummy light-emitting element Ex to operate complementarily. In this case, since the same signal may be supplied to the respective drains of the control transistors Tr1 of the light-emitting element E1 side and the light-emitting element Ex, the configuration of a control circuit is simplified.

In the configurations of FIGS. 17 and 18A, since the dummy light-emitting elements are turned on, it is necessary to shield light of the dummy light-emitting elements. For this reason, there is a problem in that the configuration of the line head becomes complicated. FIG. 18B is a circuit diagram showing an improved example to cope with the above problem. In a light-emitting element line 401*z* of the line head 410*d* in FIG. 18B, instead of the dummy light-emitting element, a resistance is connected. Here, the resistance value of the resistance R are set such that the same current as that of the light-emitting element E1 flows. The resistance R may be formed, for example, by depositing a conductive layer on the same substrate with the light-emitting element E1. In the configuration of FIG. 18B, it has an advantage in that the shielding of light to be emitted from the dummy load is not needed.

As described above, in the embodiments of the present invention shown in FIGS. 17, 18A and 18B, the dummy loads such as the dummy light-emitting elements or the resistances are connected in parallel to the light-emitting elements between the power supply lines. For this reason, the total current flowing into the connecting portions between the power supply lines to which the respective light-emitting elements are connected is constant in any connecting portions. For this reason, influences by the changes in voltage of the power supply lines are removed, and thus it is possible to equalize the quantities of emitted light.

In an another embodiment of the present invention, one feeding point 6 and the other feeding point 7 in first and second power supply lines 2 and 3 are provided at various positions with respect to a line, as described below.

Figure 19:
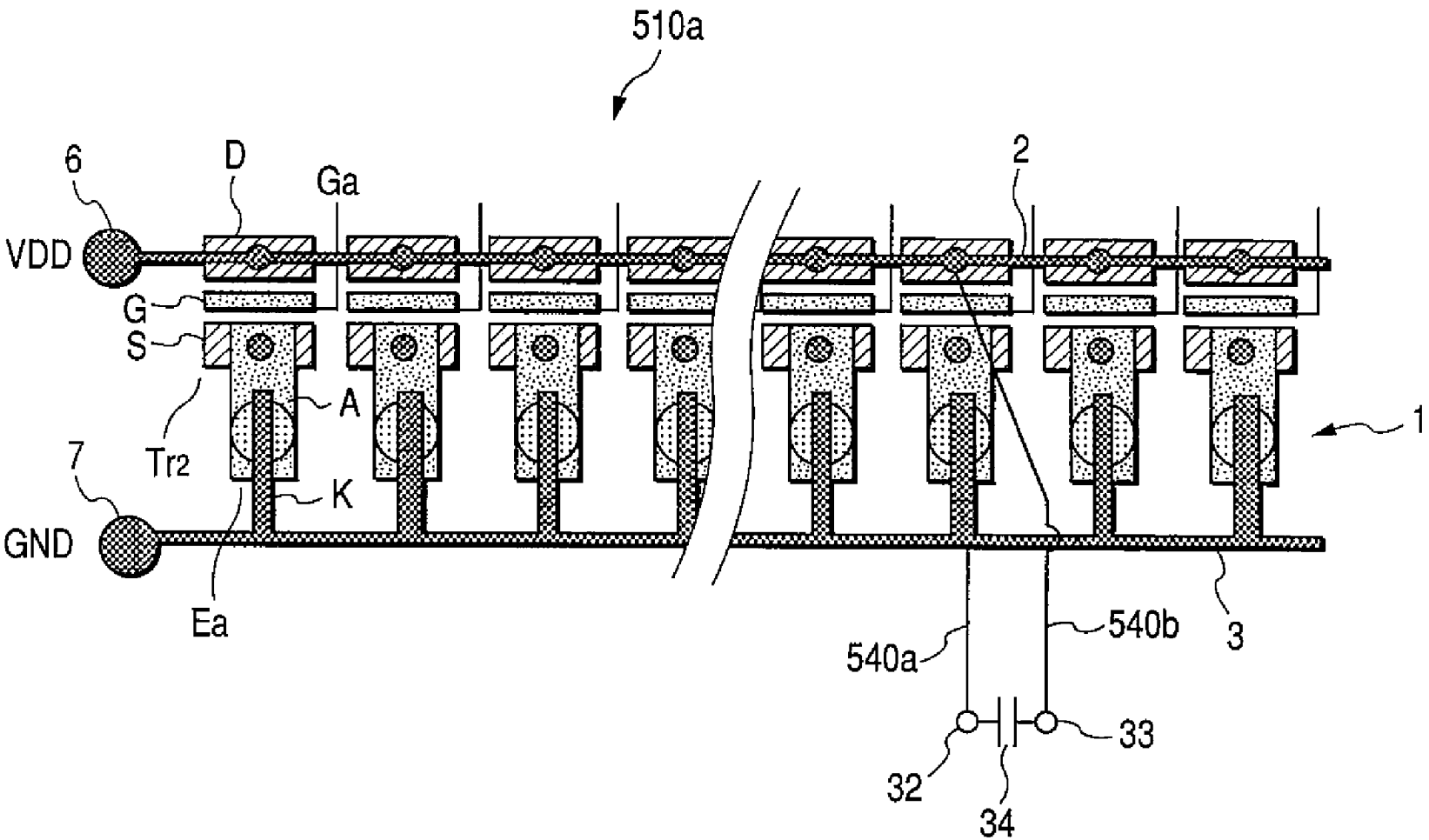
FIG. 19 is a diagram illustrating an another embodiment of the present invention.

FIG. 19 is a diagram illustrating an embodiment of the present invention. The same reference numerals as those of FIG. 34 represent the same elements. In FIG. 19, connecting lines 540*b* and 540*a* are respectively led out from a first power supply line 2 of a power supply side and a second power supply line 3 of a ground side in a line head 510*a*. And then, in the connecting line 540*a*, a terminal 32 is formed, and in the connecting line 540*b*, a terminal 33 is formed. A condenser 34 is connected between the terminals 32 and 33. The condenser 34 functions as voltage change suppressing unit between the first power supply line 2 and the second power supply line 3.

That is, in the case in which a voltage between the first power supply line 2 and the second power supply line 3 rises to more than a prescribed voltage, charges are stored in the condenser 34. In the case in which a potential of the first power supply line 2 falls down to a predetermined value, the charges stored in the condenser 34 are discharged to the power supply line 2. For this reason, it is possible to reduce influences on the quantities of emitted light of the light-emitting elements by the change in potential of the power supply line 2. Further, in the case in which an instant overvoltage is generated between the first power supply line 2 and the second power supply line 3, the condenser 34 absorbs the overvoltage such that the overvoltage is not applied to the light-emitting elements. Thus, it is possible to prevent the light-emitting elements from being damaged. As described above, in the embodiment of the present invention, since the condenser is used as the voltage change suppressing unit for power supply line, it is possible to configure the voltage change suppressing unit for power supply line with simple elements.

The condenser 34 may be connected to an arbitrary position between the first power supply line 2 and the second power supply line 3. Further, the number of connection positions is not limited to one. A plurality of connection positions may be set between the power supply lines. As described above, in the case in which the condenser 34 is connected between the power supply lines via the plurality of connection positions, it is possible to suppress surely the change in voltage over the full length of the line. Moreover, to an end portion opposite to the side at which the feeding points 6 and 7 of the line are formed, the condenser 34 in which a predetermined voltage is previously charged by an additional power supply may be connected. In this case, by discharging the charged voltage of the condenser 34, it is possible to compensate for the voltage drop of the power supply line at another end of the line as described in FIG. 34.

Figure 20:
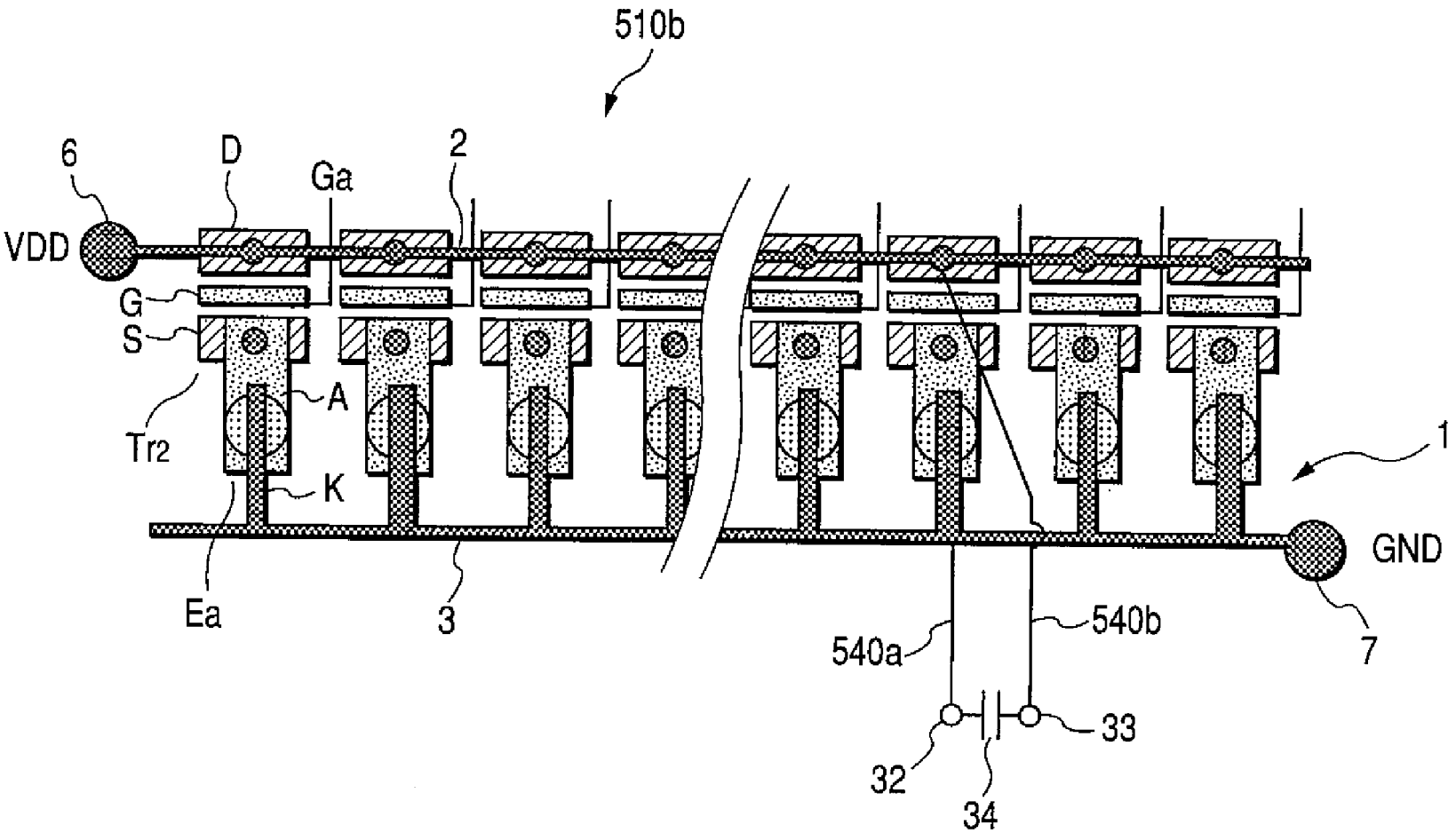
FIG. 20 is a diagram illustrating an another embodiment of the present invention.

FIG. 20 is a diagram illustrating another embodiment of the present invention. FIG. 20 shows schematically positions of the feeding points of the power supply lines which are connected to the light-emitting elements in the line head 510*b*. In the embodiment of FIG. 20, a plurality of light-emitting elements Ea are arranged in a line, and the respective light-emitting elements Ea are connected between the first power supply line 2 which is connected to the feeding point 6 of the power supply (VDD) side and the second power supply line 3 which is connected to the feeding point 7 of the ground (GND) line. Further, one feeding point 6 and another feeding point 7 are provided at opposite sides of the line.

In this example, a condenser 34 is also connected between the first power supply line 2 and the second power supply line 3. For this reason, it is possible to reduce influences on the quantities of emitted light of the light-emitting elements by the change in voltage between the first power supply line 2 and the second power supply line 3. Further, it is possible to protect the light-emitting elements from damages due to the overvoltage. Moreover, as the light-emitting element Ea, other than the organic EL element, for example, a LED (light emitting diode) may be used. Since the organic EL element can be statically controlled, it has an advantage in that a control system can be simplified. Further, in case of the LED, the manufacture of the light-emitting element is simplified.

Figure 21:
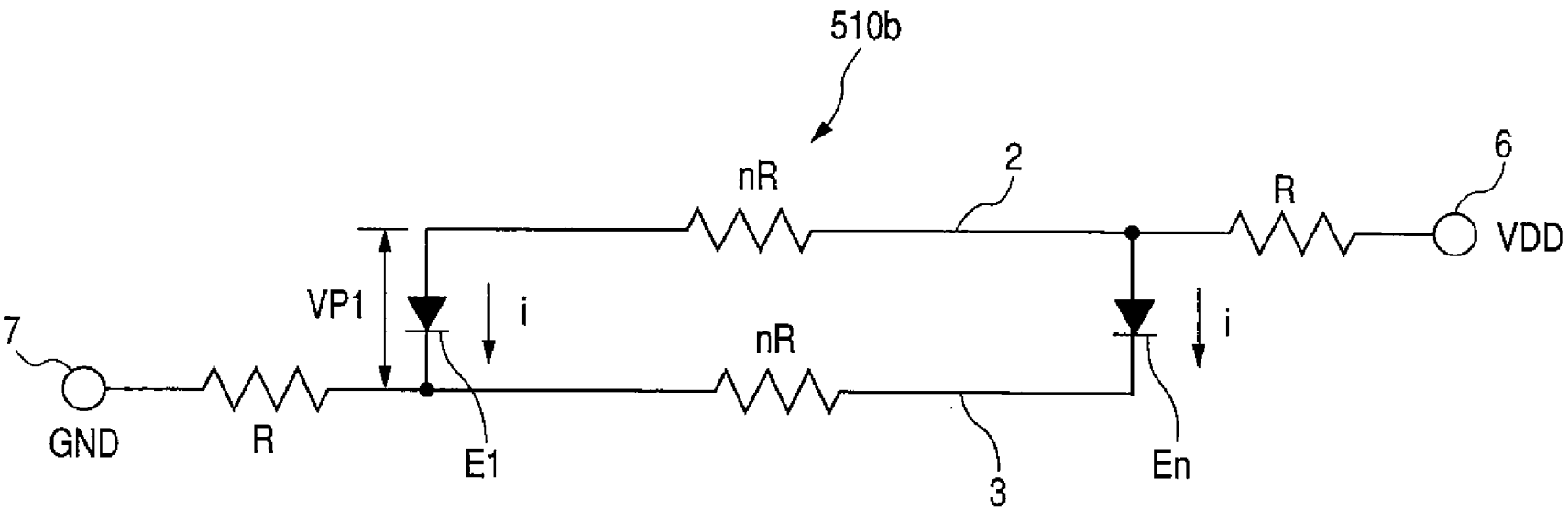
FIG. 21 is a circuit diagram of the embodiment of FIG. 20.

FIG. 21 is a schematic view illustrating the configuration of FIG. 20. In FIG. 21, the feeding point 6 of the first power supply line 2 and the feeding point 7 of the second power supply line 3 in the line head 510*b* are respectively provided at opposite sides of the line. In this case, a voltage Vp1 to be applied to a left end light-emitting element E1 satisfies the expression of Vp1=V−4Ri−nRi. Further, a voltage Vpn to be applied to a right end light-emitting element En satisfies Vpn=V−4Ri−nRi.

That is, in the example of FIG. 21, the voltage Vp1 to be applied to the left end light-emitting element E1 and the voltage Vpn to be applied to the right end light-emitting element En are the same. For this reason, the quantities of emitted light of the light-emitting elements arranged in a line become equal, such that unevenness of the life spans of the light-emitting elements is not caused. Further, it is possible to improve printing quality. As described above, in the examples of FIGS. 2 and 3, a difference of voltages to be applied to the light-emitting elements according to positions of connecting points to the first power supply line 2 is solved, and simultaneously influences by the change in voltage of the first power supply line 2 are reduced. Thus, it may be configured such that there is no difference between the quantities of emitted light of the respective light-emitting elements.

Figure 22:
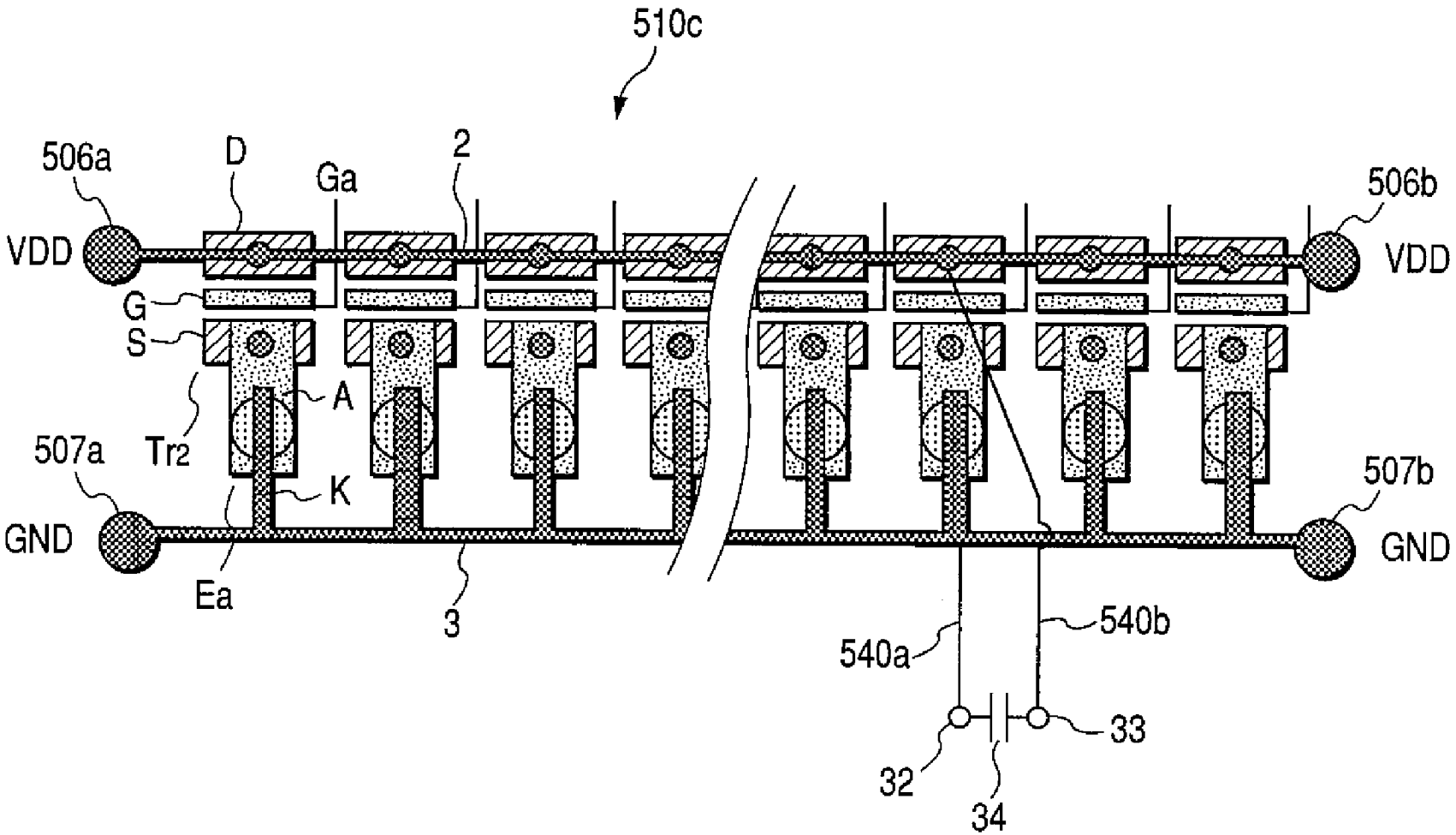
FIG. 22 is a diagram illustrating an another embodiment of the present invention.

FIG. 22 is a diagram illustrating schematically another embodiment according to the present invention. Referring to FIG. 22, in a line head 10*c*, a plurality of light-emitting elements Ea are arranged in a line, and the respective light-emitting elements Ea are connected between a first power supply line 2 which is connected to feeding points 506*a* and 6*b* of a power supply (VDD) side and a second power supply line 3 which is connected to feeding points 507*a* and 507*b* of a ground (GND) side.

Further, the feeding points 6*a* and 6*b* and the feeding points 507*a* and 507*b* are provided at both sides of the line. In FIG. 22, a condenser 34 is connected between the first power supply line 2 and the second power supply line 3. For this reason, it is possible to reduce influences on the quantities of emitted light of the light-emitting elements by the change in voltage between the first power supply line 2 and the second power supply line 3. Further, it is possible to protect the light-emitting elements from damages due to the overvoltage.

Figure 23:
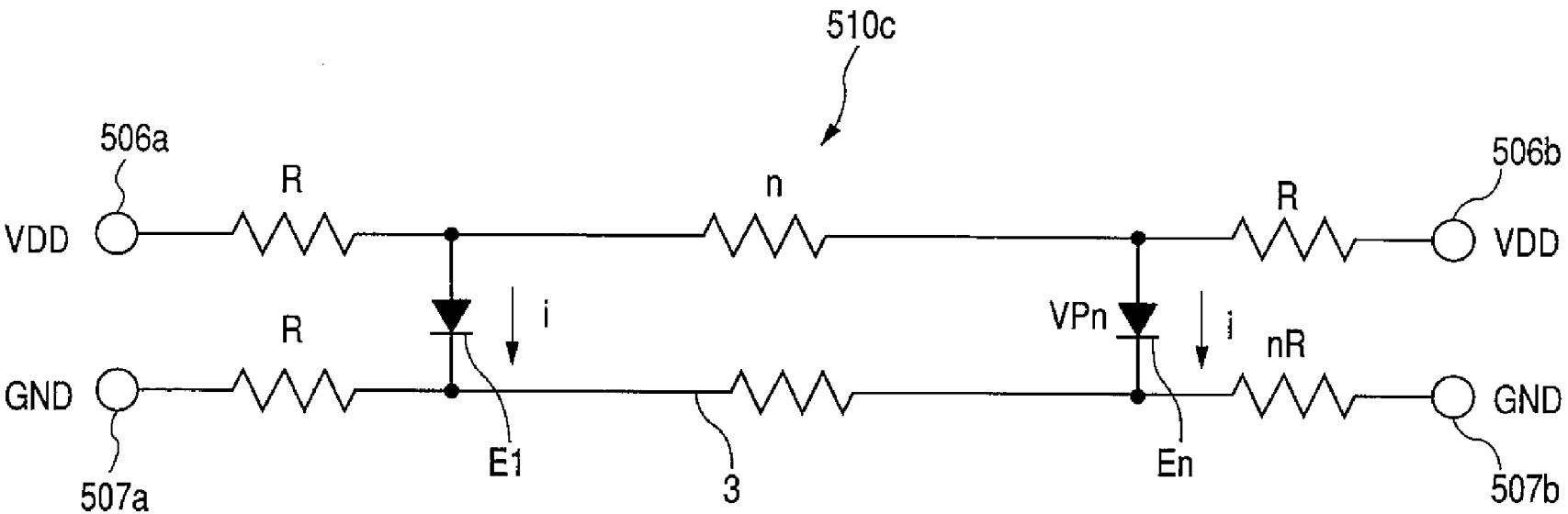
FIG. 23 is a circuit diagram of the embodiment of FIG. 22.

FIG. 23 is a circuit diagram corresponding to FIG. 22. As described above, in the line head 10*a*, the feeding points 6*a* and 6*b* of the first power supply line 2 and the feeding points 507*a* and 507*b* of the second power supply line 3 are respectively formed at both ends of the line. That is, the four feeding points are formed at both ends of the line. In this case, a voltage Vp1 to be applied to a left end light-emitting element E1 satisfies the expression of Vp1=V−nRi. Further, a voltage Vpn to be applied to a right end light-emitting element En satisfies Vpn=V−nRi.

That is, in the example of FIG. 23, the voltage Vp1 to be applied to the left end light-emitting element E1 and the voltage Vpn to be applied to the right end light-emitting element En are the same. Further, the voltage drops of the power supply lines are one-fourth times as those of the related example in FIG. 36, and then influences on the respective light-emitting elements by the voltage drops of the power supply lines can be reduced. For this reason, the quantities of emitted light of the light-emitting elements arranged in a line become equal, such that unevenness of the life spans of the light-emitting elements is not caused. Further, it is possible to improve printing quality.

As described above, in the examples of FIGS. 22 and 23, as compared to the arrangement example of the feeding points of the related example shown in FIG. 36, a difference between the voltages to be applied to the light-emitting elements according to the positions of the connecting points to the first power supply line 2 can be reduced. Further, by connecting the condenser 34, influences by the change in voltage to be generated between the first power supply line 2 and the second power supply line 3 are reduced. Thus, it may be configured such that there is no difference between the quantities of emitted light of the respective light-emitting elements.

Figure 24:
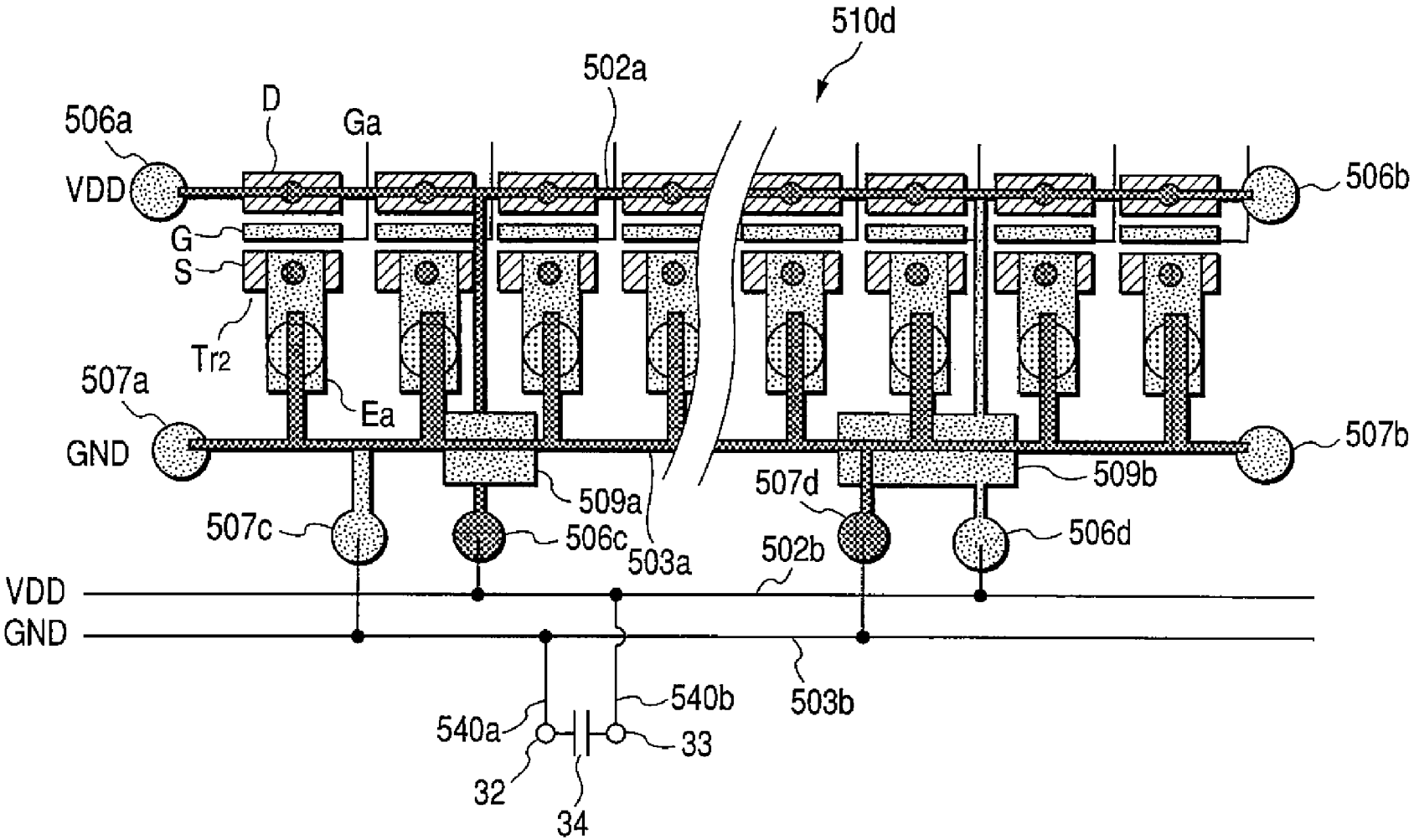
FIG. 24 is a diagram illustrating an another embodiment of the present invention.

FIG. 24 is a diagram illustrating schematically another embodiment according to the present invention. Referring to FIG. 24, in a line head 510*d*, a plurality of light-emitting elements Ea are arranged in a line, and the respective light-emitting elements Ea are connected between a first power supply line 502*a* which is connected to feeding points 506*a* and 506*b* of a power supply (VDD) side and a second power supply line 503*a* which is connected to feeding points 507*a* and 507*b* of a ground (GND) side. And then, the feeding points 6*a* and 6*b* and the feeding points 507*a* and 507*b* are provided at both sides of the line.

Further, a third power supply line 502*b* of the power supply side and a fourth power supply line 503*b* of the ground side are arranged along a lengthwise direction of the line. To the third power supply line 502*b* and the fourth power supply line 503*b*, a plurality of second feeding points 506*c*, 506*d*, 507*c* and 507*d* are respectively connected. The second feeding points 506*c*, 506*d*, 507*c* and 507*d* are connected to the first power supply line 502*a* and the second power supply line 503*a*. Reference numerals 509*a* and 509*b* denote insulating portions which are provided at portions at which connecting portions of the second feeding points 506*c* and 506*d* with the first power supply line 502*a* intersect the second power supply line 503*a*.

A condenser 34 is connected between the third power supply line 502*b* of the power supply side and the fourth power supply line 503*b*. For this reason, it is possible to reduce influences on the quantities of emitted light of the light-emitting elements by the change in voltage between the third power supply line 502*b* and the fourth power supply line 503*b*. Further, it is possible to protect the light-emitting elements from damages when an overvoltage is applied between the third power supply line 502*b* and the fourth power supply line 3*b*. Further, the condenser 34 may be connected between the first power supply line 502*a* and the second power supply line 503*a*. In this case, it is possible to reduce influences on the quantities of emitted light of the light-emitting elements by the change in voltage between the first power supply line 502*a* and the second power supply line 503*a*. Further, it is possible to protect the light-emitting elements from damages due to the overvoltage.

Figure 25:
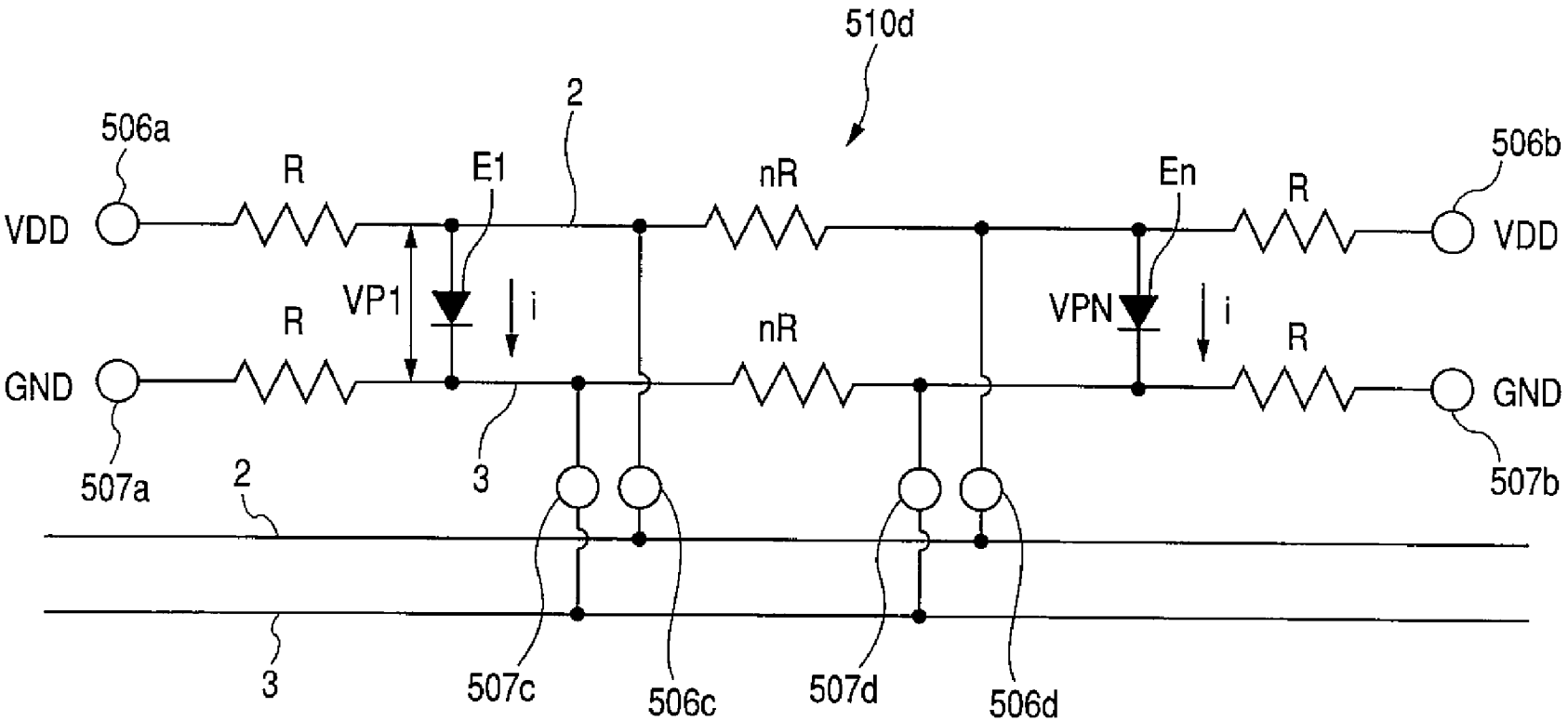
FIG. 25 is a diagram illustrating an another embodiment of the present invention.

FIG. 25 is a circuit diagram corresponding to FIG. 24. As described above, the first feeding points 506*a* and 506*b* of the first power supply line 502*a* and the first feeding points 507*a* and 507*b* of the second power supply line 503*a* are respectively provided at both ends of the line. Further, the third power supply line 502*b* of the power supply side and the fourth power supply line 503*b* of the ground side are formed along the lengthwise direction of the line.

In the third power supply line 502*b* of the power supply side and the fourth power supply line 503*b* of the ground side, feeding points are respectively provided. In the third power supply line 502*b* of the power supply side, the second feeding points 506*c* and 506*d* are provided. Further, in the fourth power supply line 503*b* of the ground side, the second feeding points 507*c* and 507*d* are provided. The second feeding points 506*c* and 506*d* of the power supply side are connected to the first power supply line 502*a*. In addition, the second feeding points 507*c* and 507*d* of the ground side are connected to the second power supply line 503*a*. Moreover, the first power supply line 502*a* of the power supply side and the third power supply line 502*b* may be connected to the same power supply or they may be connected to different power supplies.

As described above, in the examples of FIGS. 24 and 25, the feeding points of the power supply lines are provided at both sides of the line and simultaneously the number of the feeding points of the power supply lines increases. Thus, it is possible to suppress influences on the respective light-emitting elements by the changes in voltage of the power supply lines. For this reason, the quantities of emitted light of the light-emitting elements arranged in a line can be equalized, and unevenness of the life spans of the light-emitting elements is not caused. Further, it is possible to improve printing quality. Moreover, in FIGS. 24 and 25, similarly to FIGS. 34 and 35, the first feeding points may be provided only at one end portion of the line.

Further, in FIGS. 24 and 25, two second feeding points are provided at the power supply side and the ground side, but one second feeding point may be provided. In addition, the second feeding points are not needed to be set at the power supply side and the ground side in the same number and at the same positions. The different number of second feeding points may be provided at different positions of the power supply side and the ground side, for example, in a cross-stitch shape. In such a manner, the positions or the number of the second feeding points may be set arbitrarily. Moreover, the second feeding points may be provided around the first feeding points 506*a*, 507*a*, 506*b* and 507*b* which are provided at both ends of the line shown in FIGS. 24 and 25.

In this case, the second feeding points are respectively connected to the first power supply line 502*a* of the power supply side and the second power supply line 503*a* of the ground side. In such a manner, since the second feeding points are arranged, influences by the voltage drops of the power supply lines can be reduced. For this reason, the difference between the voltages to be applied to the light-emitting elements can be removed, and thus it is possible to equalize the quantities of emitted light.

As described above, in the examples of FIGS. 24 and 25, as compared to the arrangement example of the feeding points of the related example shown in FIG. 36, a difference between the voltages to be applied to the light-emitting elements according to the positions of the connecting points to the first power supply line 502*a* can be reduced. Further, by connecting the condenser 34, influences by the change in voltage to be generated between the third power supply line 502*b* and the fourth power supply line 503*b* are reduced. Thus, it may be configured such that there is no difference between the quantities of emitted light of the respective light-emitting elements. In addition, in the case in which the condenser 34 is connected between the first power supply line 502*a* and the second power supply line 503*a*, it is possible to reduce influences by the change in voltage to be generated between the first power supply line 502*a* and the second power supply line 503*a*.

Figure 26:
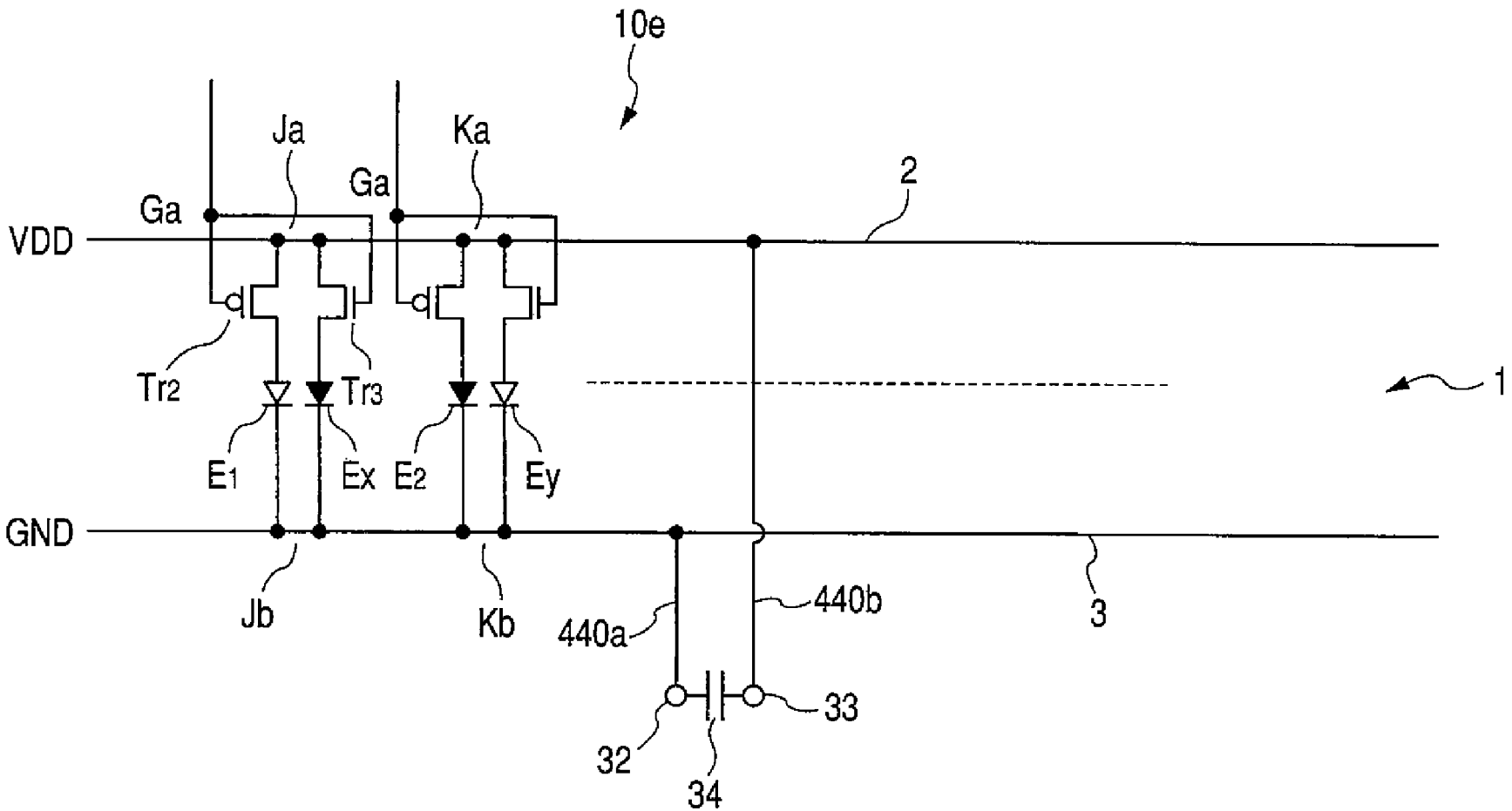
FIG. 26 is a diagram illustrating an another embodiment of the present invention.

Next, an another embodiment of the invention is explained as shown in FIG. 26. In FIG. 26, a condenser 34 is added to the configuration of FIG. 17. In particular, the condenser 34 is connected between the first power supply line 2 of a power supply side and the second power supply line 3 of a ground side. For this reason, it is possible to reduce influences on the quantities of emitted light of the light-emitting elements by the change in voltage between the first power supply line 2 and the second power supply line 3. Further, it is possible to protect the light-emitting elements from damages due to an overvoltage. As regards the condenser 34, a connection position with the first power supply line 2 of the power supply side and the second power supply line 3 of the ground side may be arbitrarily set, as described above.

Figure 27:
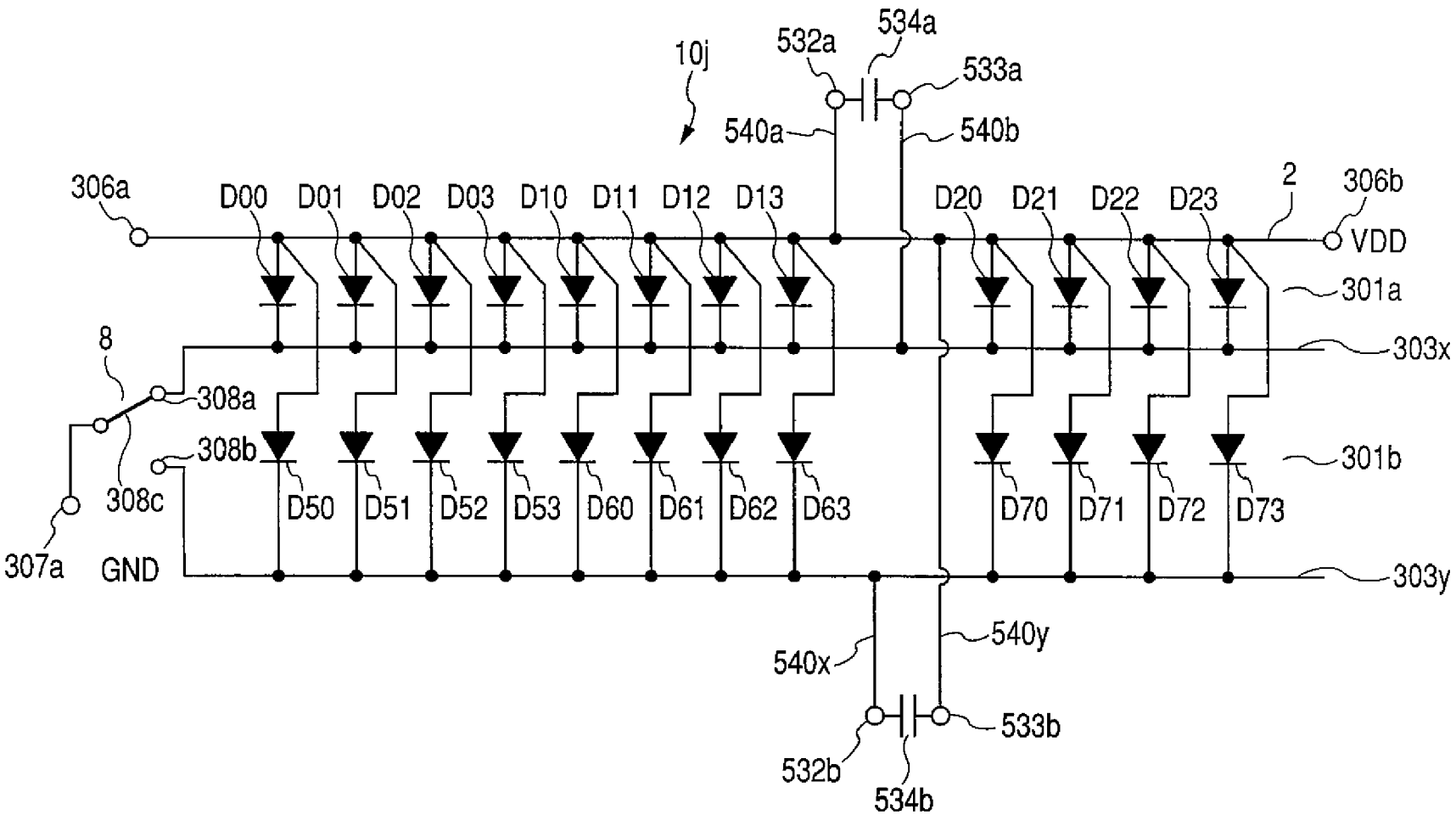
FIG. 27 is a diagram illustrating an another embodiment of the present invention.

In an another embodiment shown in FIG. 27, a voltage change suppressing condenser is connected between the power supply lines of the power supply side and the power supply lines of the ground side in the respective light-emitting element lines 1*a* to 1*d*. The configuration of FIG. 27 shows the voltage suppressing condensers 534*a*, 534*b* added to the configure of FIG. 16. In this case, it is possible to reduce influences on the quantities of emitted light of the light-emitting elements by the changes in voltage between the power supply lines, and it is possible to protect the light-emitting elements from the overvoltage.

In particular, connecting lines 540*a* and 540*b* are connected to the first and second power supply lines 2 and 303*x* respectively, and a voltage change suppressing condenser 534*a* is connected to terminals 532*a* and 533*a*. Further, connecting lines 540*x* and 540*y* are connected to the first and second power supply lines 2 and 303*y* respectively. In this case, it is possible to reduce influences on the quantities of emitted light of the light-emitting elements by the changes in voltage between the power supply lines, and further it is possible to protect the light-emitting elements from the overvoltage.

In an another embodiment of the present invention, as described below, one feeding point 6 and the other feeding point 7 are provided at long sides of the first and second power supply lines 2 and 3, respectively.

Figure 28:
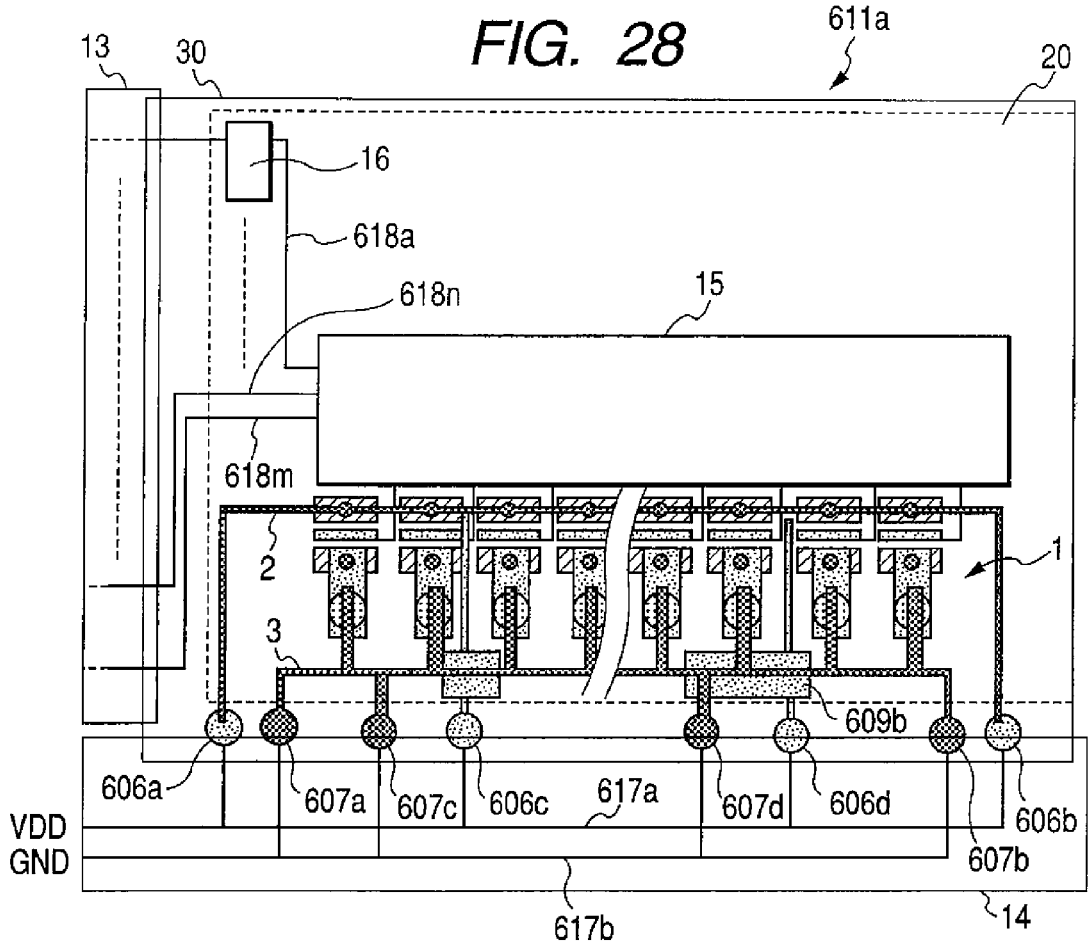
FIG. 28 is a diagram illustrating an another embodiment of the present invention.

FIG. 28 is a view shown an embodiment of the present invention. In FIG. 28, the reference numeral 611*a* denotes a housing of the line head, and a light-emitting element line 1, a control circuit 15, and an electrostatic breakdown prevention circuit 16 are provided on a substrate 30. A first FPC (Flexible Printed Circuit) 13 whose length is shortened is provided at the short side of the line head. At the long side of the liner a second FPC 14 is provided along the line. A moisture-proof plate 20 for protecting the light-emitting element mounted in the substrate 30 is provided on upper layer of the substrate 30.

Control signals that drive transistors provided with respect to the light-emitting elements arranged in the light-emitting element line 1 or control transistors is formed in the control circuit 15. A control signal line 618*a* to be connected to the above electrostatic breakdown prevent circuit 16 and control signal lines 618*n* and 618*m* to be leaded out to the external are connected to the control circuit 15.

As shown in FIG. 28, according to the present embodiment, the first feeding points 606*a* and 606*b* at the power supply (VDD) side and the first feeding point 607*a* and 607*b* at the ground (GND) side are provided at both sides of the line. In the example shown in FIG. 28, the first power supply line 2 and the second power supply line 3 are bent at right angles such that the first feeding points 606*a* and 606*b* provided at the both sides of the line and the first feeding points 607*a* and 607*b* are arranged in the second FPC 14 provided in the lengthwise direction of the line.

The first feeding points 606*a* and 606*b* and the first feeding points 607*a* and 607*b* are connected to the first external power supply line 617*a* at the power source (VDD) side and the second external power supply line 617*b* at the ground (GND) side which are wired in the second FPC 14. Between the first feeding points 606*a* and 606*b* provided at the both sides of the line, a plurality of second feeding points 606*c* and 6*d* are arranged to be connected to the first external power supply line 617*a* at the power source (VDD) side.

Similarly, between the first feeding points 607*a* and 607*b* provided at the both sides of the line, a plurality of second feeding points 607*c* and 607*d* are arranged to be connected to the second external power supply line 617*b* at the ground (GND) side. The reference numeral 609*a* denotes an insulating material for connection preventing which is provided at an intersection of a lead line for connecting the first power supply line 2 to the feeding point 606*a* and the second power supply line 3. In addition, the reference numeral 609*b* is an insulating material which is provided at an intersection of a lead line for connecting the first power supply line 2 to the feeding point 606*d* and the second power supply line 3.

As mentioned above, in the example shown in FIG. 28, the feeding point of the first power supply line at the power supply side and the feeding point of the second power supply line at the ground side are provided at the both side of the line, the plurality of second feeding points are provided at the power supply side and the ground side, and thus the number of feeding points increase. Therefore, it is possible to suppress the influence on the light-emitting elements due to the change in the potential of the power supply line. Therefore, there is no different in the amount of light emitted from the light-emitting element arranged in a line, and there is no variation in the effective life time of the light-emitting element.

Further, in FIG. 28, the second feeding points are provided at two locations of the power supply side and at three locations of the ground side. However, the second feeding point may be provided only at one location. Further, the second feeding points may be provided at the same location with the same number at the power supply side and the ground side. Furthermore, the second feeding points are arranged in zigzags at different locations with the different number at the power supply side and the ground side. Accordingly, it is possible to arbitrarily set the position and the number of the second feeding points. The second feeding points may be provided at a vicinity of the first feeding points 606*a*, 607*a*, 606*b*, and 607*b* which are provided at the both sides of the line in FIG. 28.

Therefore, it is possible to reduce the influence of the voltage drop of the power supply line by providing the second feeding points in this way. Since the difference in voltage applied to the respective light-emitting element decreases, it is further possible to equalize the amount of emitted light. As a result, in this example in FIG. 28, compared to the related arrangement of the feeding points shown in FIG. 32, it is possible to reduce the difference in the applied voltage due to the position of the connecting point with respect to the first power supply line 2 of the light-emitting element.

Further, in the example of FIG. 28, the first FPC 13 whose length is shortened in the vertical direction is provided at the short side of the line and the second FPC 14 is provided along the line at the long side of the line. In this manner, FPCs are divided into two parts at the long side and the short side of the line to be arranged in an empty space of the line head. Therefore, compared to the related structure shown in FIG. 32, since the size at the short side of the line is smaller, it is possible to save the space for arranging the housing. The light-emitting device line is formed at the long side of the line head, which is sensationally required. Therefore, the size of the long side does not change in spite of the second FPC 14. In addition, since the wiring line of the control circuit and the wiring line of the power supply line are mounted by using the FPC having flexibility, it is possible to easily mount the wiring lines, even in case of bending the line head.

Figure 29:
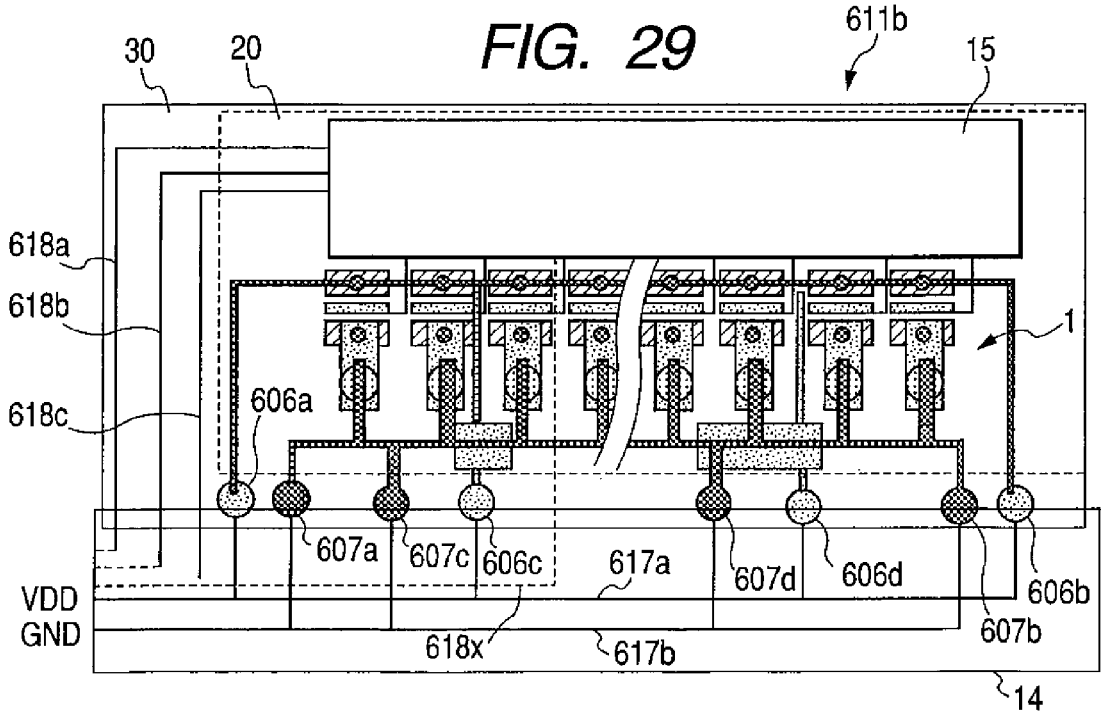
FIG. 29 is a diagram illustrating an another embodiment of the present invention.

FIG. 29 is a view showing another embodiment according to the present invention. The same parts as those in FIG. 28 denote the same reference numerals as in FIG. 28. In an example of FIG. 29, the first FPC 13 shown in FIG. 28 will be omitted. Signal lines 18*a* to 18*c* connected to the control circuit 15 are led from the short side of the line head to the external directly. In this manner, in the example of FIG. 29, since the FPC provided in the vertical direction at the short side of the line head is omitted, it is possible to considerably save the space in the short side direction of the housing 611*b*.

Since the signal lines 618*a* to 618*c* connected to the control circuit 15 are wired at the long side of the line head, the size of the long side becomes large by that much. However, in the end portion of the line head, a wheel array system for driving an image carrier and so on is arranged, and, from a viewpoint of the entire housing, it does not cause the size to be enlarged by that much.

A reference numeral 618*x* is a signal line which is wired from the FPC 14 to the control circuit 15. As described above, in the FPC 14, the wiring lines of the power supply lines to the feeding points 606*a* to 606*d* and 607*a* to 607*d* and the wiring lines to the control circuit 15 may be provided. Moreover, since the wiring lines can be provided in the FPC with high density, the control circuit 15 may be omitted in FIG. 29. In this case, the control signals for driving the drive transistors or the control transistors which are provided to the respective light-emitting elements are formed outside, and the signal lines are wired in the FPC. Therefore, it is possible to further reduce the size of the short side in the housing of the line head.

Figure 31A:
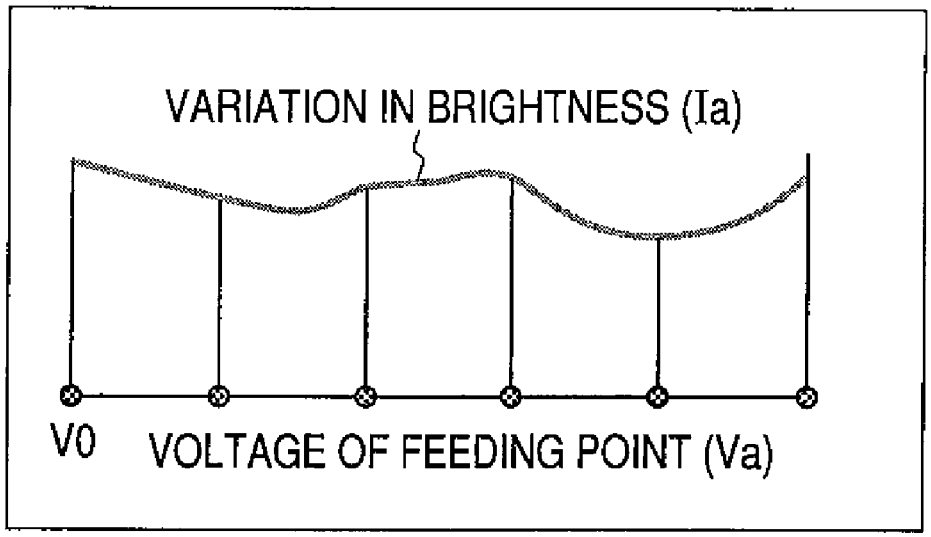
FIG. 31 is a diagram illustrating an another embodiment of the present invention.
Figure 31B:
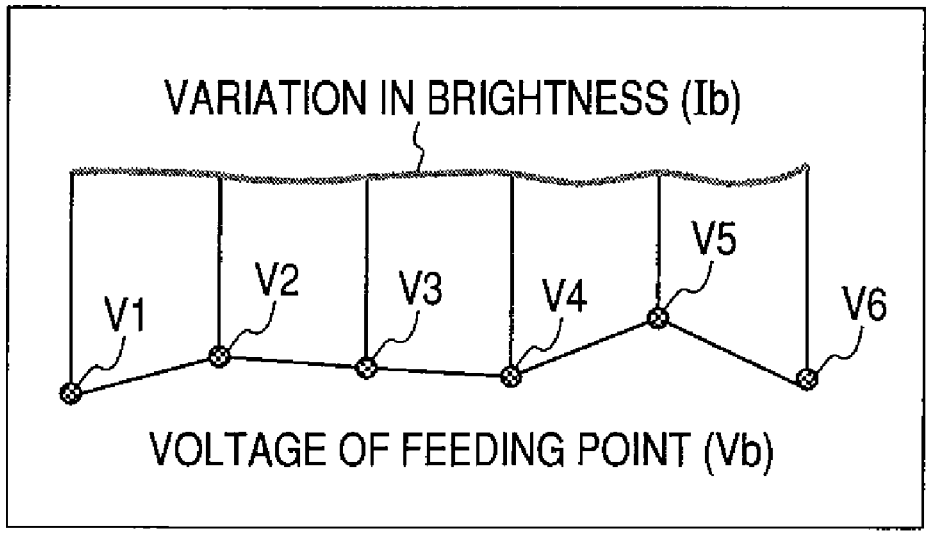

By the way, when the same voltage is applied to the light-emitting elements, unevenness in brightness is caused due to manufacturing causes. FIGS. 31A and 31B are diagrams showing characteristics of the light-emitting elements. As shown in FIG. 31A, if the voltage characteristics (Va) of the respective feeding points are set to a constant value (V0), the brightness characteristics of the light-emitting elements become (Ia), and then unevenness is caused. Here, as shown in FIG. 31B, if the voltage characteristics (Vb) of the respective feeding points are allowed to change in a range of V1 to V6 according to the voltage difference of the power supply lines, the brightness characteristics of the light-emitting elements can have the approximately constant value (Ib). The voltages of the respective feeding points are suitably set in accordance with unevenness in brightness of the light-emitting elements.

Figure 30:
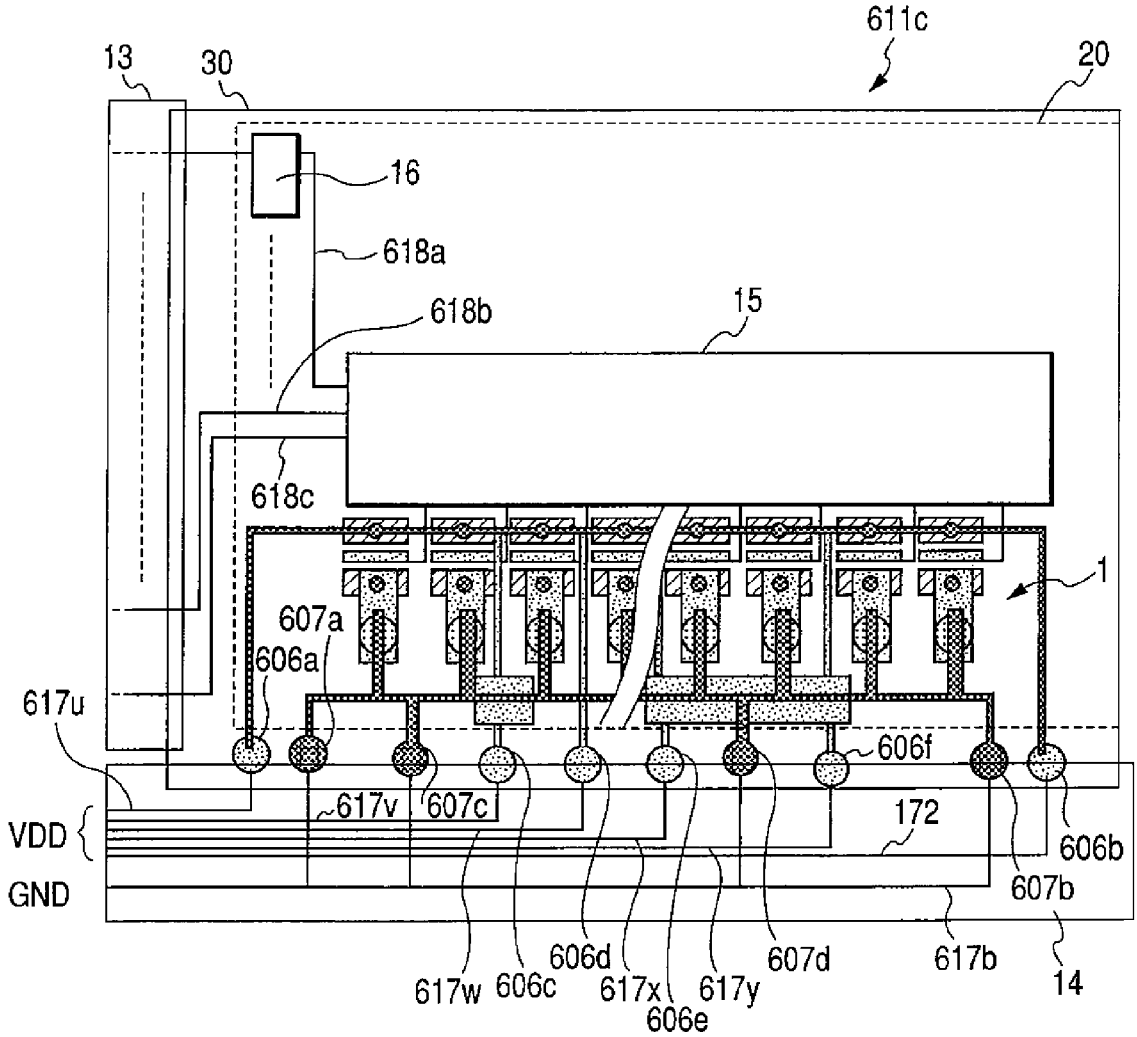
FIG. 30 is a circuit diagram of the embodiment of FIG. 29.

FIG. 30 is a diagram illustrating an example for implementing the bright characteristics of FIG. 31B. The same reference numerals as those of FIG. 28 represent the same elements. Referring to the example of FIG. 30, in a first external power supply line which is wired in a second FPC 14, additional external power supply lines 617*u* to 617*z* are connected to the respective second feeding points 606*a* to 606*f* of the power supply side. For this reason, different voltages are supplied from the external power supply lines 617*u* to 617*z* to the second feeding points 606*a* to 606*f* of the power supply side.

In the example of FIG. 30, as described above, the voltages of the respective feeding points are set in accordance with unevenness in brightness of the respective light-emitting elements. The voltages between the feeding points are divided proportionally by resistances of the power supply lines. Moreover, in the example of FIG. 30, the voltage in the power supply (VDD) side is adjusted by the external power supply lines, but the voltage in the ground (GND) side may be adjusted or the voltage in both the power supply side and the ground side may be adjusted. The number of the feeding points can be set according to a degree of unevenness in brightness or required uniformity of the quantity of emitted light.

In the above description, a line head to be used for an image forming device such as a monochrome printer is oriented. In the present invention, however, the line head according to the present invention can be applied to four-cycle color printer or a tandem type color printer. In these color printers, by adopting the configuration of the present invention, it is possible to suppress unevenness of the amount of light emitted from the respective light-emitting elements arranged in the line head.

Figure 32:
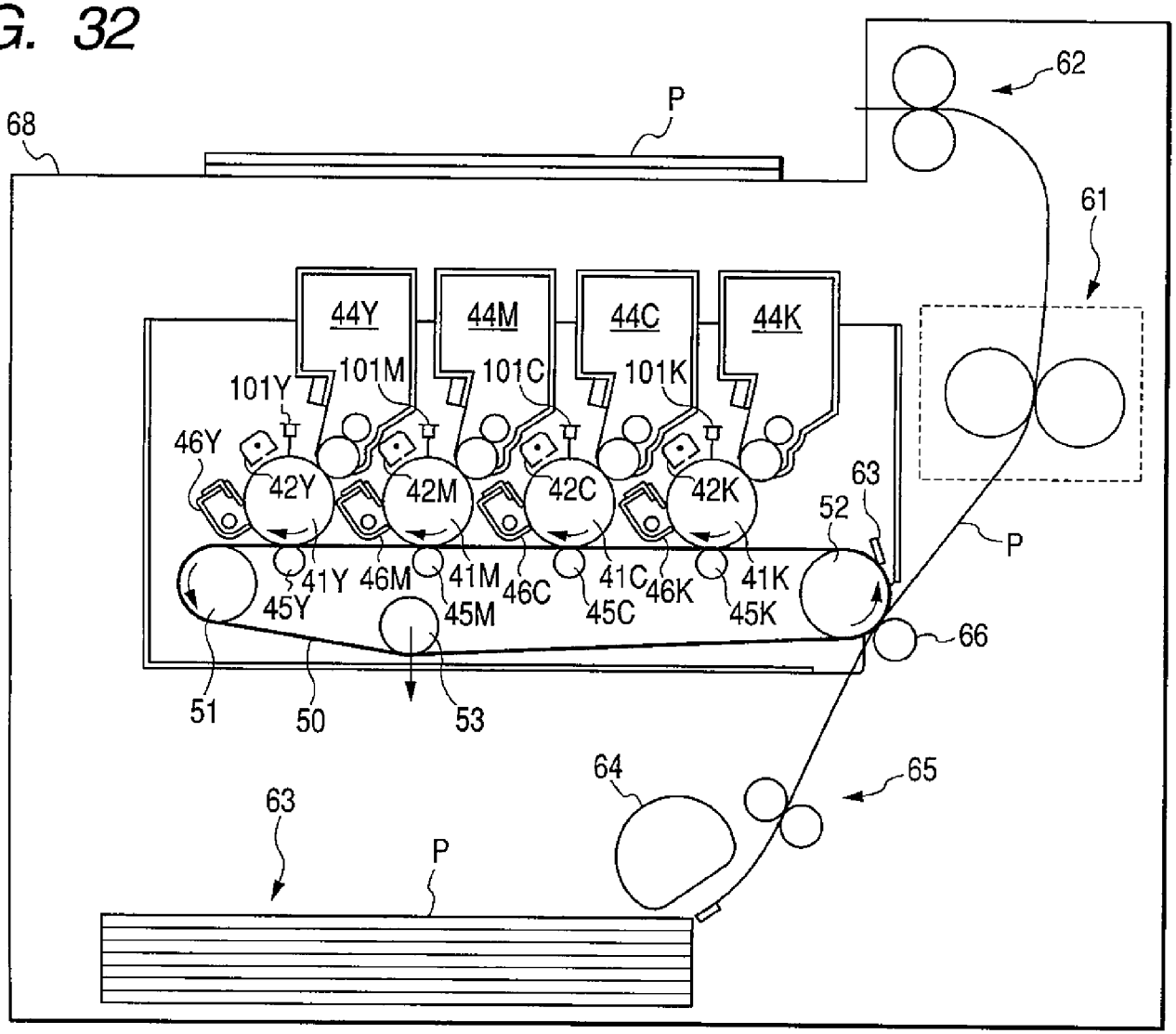
FIG. 32 is a longitudinal cross-sectional side view showing a schematic configuration of a tandem type image forming device of the present invention.

FIG. 32 is a longitudinal cross-sectional side view showing an example of an image forming device in which an organic EL element is used as the light-emitting element. In the image forming device, four organic EL array exposing heads 101K, 101C, 101M and 101Y having the same configuration are arranged at exposure positions of four photosensitive drums (image carrier) 41K, 41C, 41M and 41Y which have the same configuration and correspond the exposing heads. Further, the image forming device is a tandem type image forming device.

As shown in FIG. 32, the image forming device comprises a driving roller 51, a driven roller 52 and a tension roller 53. The image forming device further comprises an intermediate transfer belt 50 which is stretched by tension from the tension roller 53 and is circularly driven in an arrow direction of FIG. 32 (counterclockwise direction). As four image carriers spaced apart from the intermediate transfer belt 50, photosensitive bodies 41K, 41C, 41M and 41Y of which circumferential surfaces are respectively covered with photosensitive layers are arranged.

The marks K, C, M and Y appended to the numerals means black, cyan, magenta and yellow respectively, and the reference numerals 41K, 41C, 41M and 41Y represent the photosensitive bodies for black, cyan, magenta and yellow respectively. The same is applied to other elements. The photosensitive bodies 41K, 41C, 41M and 41Y rotate in an arrow direction of FIG. 32 (clockwise direction) in synchronization with the driving of the intermediate transfer belt 5Q.

Around the respective photosensitive bodies 41K, 41C, 41M and 41Y, charging units (corona charger) 42K, 42C, 42M and 42Y for charging the circumferential surfaces of the photosensitive bodies 41K, 41C, 41M and 41Y together, and the organic EL array exposing heads (line head) 101K, 101C, 101M and 101Y for sequentially linearly scanning the circumferential surfaces charged together by the charging units 42K, 42C, 42M and 42Y in synchronization with the rotations of the photosensitive bodies 41K, 41C, 41M and 41Y as described above are provided.

Further, developing devices 44K, 44C, 44M and 44Y for imparting toners as developers to an electrostatic latent image formed by the organic EL array exposing heads 101K, 101C, 101M and 101Y to form a visible image (toner image), primary transfer rollers 45K, 45C, 45M and 45Y for sequentially transferring the toner image developed by the developing units 44K, 44C, 44M and 44Y to the intermediate transfer belt 50 as a primary transfer object, and cleaning devices 46K, 46C, 46M and 46Y as cleaning units for removing the toners remaining on the surfaces of the photosensitive bodies 41K, 41C, 41M and 41Y after transferring are provided.

Here, the respective organic EL array exposing heads 101K, 101C, 101M and 101Y are arranged such that an array direction of the organic EL array exposing heads 101K, 101C, 101M and 101Y follows a mother line of the photosensitive drums 41K, 41C, 41M and 41Y. And then, peak wavelengths of light-emitting energy of the respective organic EL array exposing heads 101K, 101C, 101M and 101Y are set to approximately accord with sensitivity peak wavelengths of the photosensitive bodies 41K, 41C, 41M and 41Y.

Since the developing devices 44K, 44C, 44M and 44Y use non-magnetic single-composition toners as the developers, the single-composition toners are transported to developing rollers by supply rollers, for example, the film thicknesses of the developers attached to the surfaces of the developing rollers are regulated by regulating blades, and then the developing rollers contact with or are pressed onto the photosensitive bodies 41K, 41C, 41M and 41Y. Accordingly, according to the levels of potentials on the photosensitive drums 41K, 41C, 41M and 41Y, the developers are attached, such that the toner image is developed.

The respective toner images of black, cyan, magenta and yellow which are respectively formed by such four monochrome toner image forming stations are sequentially transferred to the intermediate transfer belt 50 by a primary transfer bias to be applied to the primary transfer rollers 45K, 45C, 45M and 45Y, and they are sequentially overlapped on the intermediate transfer belt 50 to form a full color toner image. And then, this full color toner image is secondarily transferred on the printing medium P such as a paper in the secondary transfer roller 66, and passes through a fixing roller pair 61 as a fixing portion, such that the full color toner image is fixed on the printing medium P. And then, by a discharging roller 62, the printing medium P is discharged on a discharged paper tray 68 which is formed in an upper portion of the device.

Moreover, in FIG. 32, a reference numeral 63 denotes a supply paper cassette in which sheets of the printing mediums P are deposited and held, and a reference numeral 64 denotes a pickup roller which supplies the printing medium P from the supply paper cassette 63 by one sheet. Further, a reference numeral 65 denotes a gate roller pair which defines a supply timing of the printing medium P to the secondary transfer portion of a secondary transfer roller 66, and the reference numeral 66 denotes the secondary transfer roller as secondary transfer unit which forms the secondary transfer portion with respect to the intermediate transfer belt 50. Further, a reference numeral 67 denotes a cleaning blade as cleaning unit which removes the toner remaining on the surface of the intermediate transfer belt 50 after secondarily transferring.

As described above, since the image forming device of FIG. 32 uses the organic EL array as writing unit, it is possible to plan the miniaturization of the device, as compared to the case in which a laser scanning optical system is used.

Figure 33:
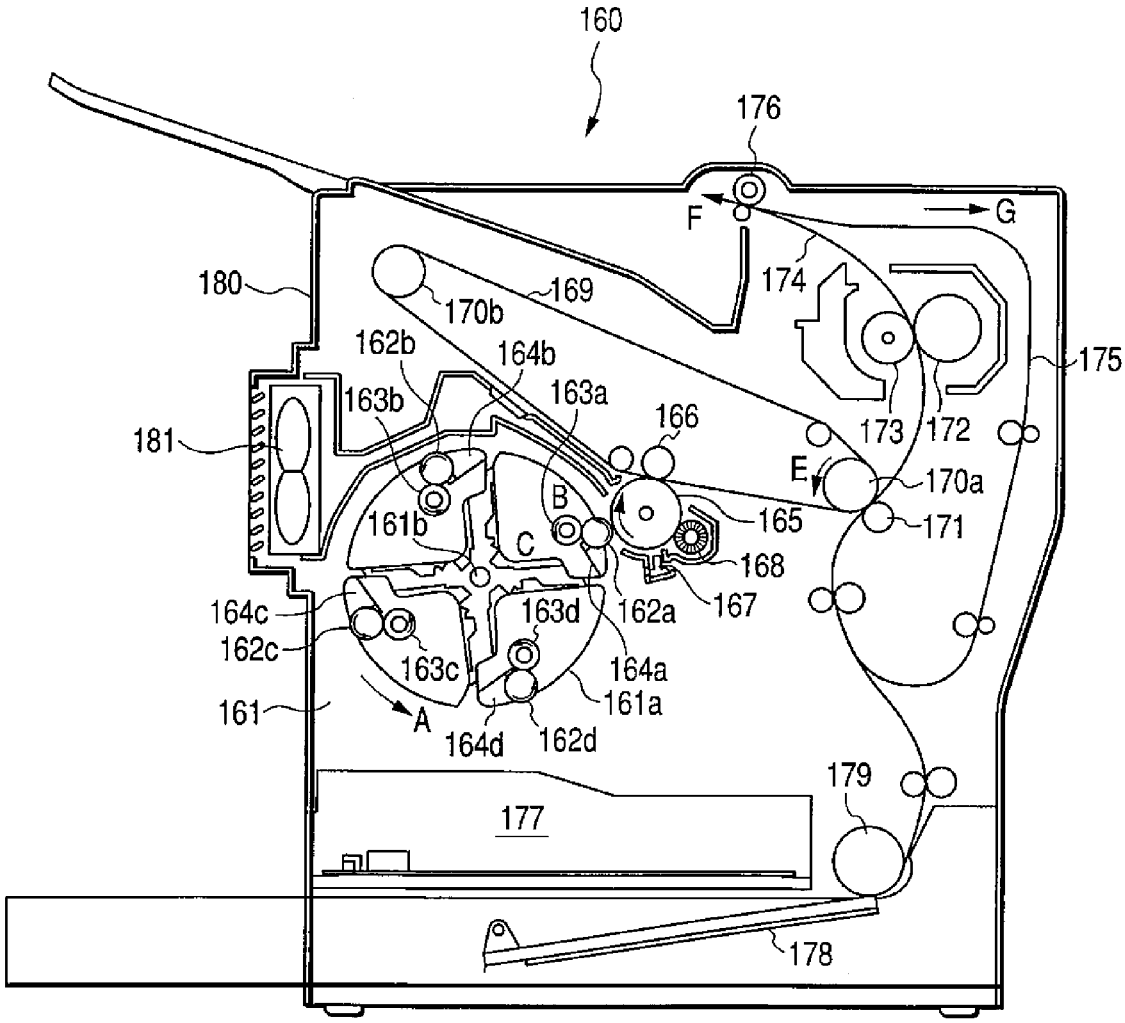
FIG. 33 is a longitudinal cross-sectional side view of an image forming device showing another embodiment of the present invention.

Next, another embodiment of an image forming device according to the present invention will be described. FIG. 33 is a longitudinal cross-sectional side view of the image forming device. In FIG. 33, in the image forming device 160, as main elements, a developing device 161 having a rotary structure, a photosensitive drum 165 serving as an image carrier, image writing unit (line head) 167 provided with an organic EL array, an intermediate transfer belt 169, a paper transport path 174, a heating roller 172 as a fixer, and a paper supply tray 178 are provided.

In the developing device 161, a developing rotary 161*a* rotates in a direction of an arrow A around an axis 161*b*. The inside of the developing rotary 161*a* is divided into four divisions in which image forming units for four colors of yellow (Y), cyan (C), magenta (M) and black (K) are provided respectively. Reference numerals 162*a* to 162*d* denote developing rollers which are arranged in the respective image forming units for the four colors and rotate in a direction of an arrow B, and reference numerals 163*a* to 163*d* denote toner supply rollers which rotate in a direction of an arrow C. Further, reference numerals 164*a* to 164*d* denote regulating blades which regulate the toners at a predetermined thickness.

A reference numeral 165 denotes a photosensitive drum serving as an image carrier as described above, a reference numeral 166 denotes a primary transfer member, a reference numeral 168 denotes a charger, and a reference numeral 167 denotes image writing unit. The organic EL array is provided with these elements. The photosensitive drum 165 is driven in a direction of an arrow D opposite to the developing roller 162 by a driving motor (not shown) such as a stepping motor.

The intermediate transfer belt 169 is stretched between the driven roller 170*b* and the driving roller 170*a*, and the driving roller 170*a* is connected to the driving motor of the photosensitive drum 165, such that a power is supplied to the intermediate transfer belt. By the driving of the driving motor, the driving motor 170*a* of the intermediate transfer belt 169 rotates in a direction of an arrow E opposite to the photosensitive drum 165.

In the paper transport path 174, a plurality of transporting rollers and a discharging roller pair 176 are provided, such that a paper is transported. A one-side image (toner image) to be carried on the intermediate transfer belt 169 is transferred on one side of a paper at a position of the secondary transfer roller 171. The secondary transfer roller 171 contacts with or falls apart from the intermediate transfer belt 169 by a clutch, and when the clutch is turned on, it contacts with the intermediate transfer belt 169 such that the image is transferred to the paper.

Next, on the paper in which the image is transferred in such a manner, a fixing processing is performed by the fixer having a fixing heater H. In the fixer, a heating roller 172 and a pressing roller 173 are provided. After the fixing processing, the paper is pulled into the discharging roller pair 176 and is progressed in a direction of an arrow F. In this situation, if the discharging roller pair 176 rotates in an opposite direction, the paper is inverted and is progressed to a both-sided printing transport path 175 in a direction of an arrow G. A reference numeral 177 denotes an electronic component-equipped box, a reference numeral 178 denotes a supply paper tray for storing papers, and a reference numeral 179 denotes a pickup roller provided in an exit of the supply paper tray 178.

In the paper transport path, as the driving motor for driving a transport roller, for example, a low-speed brushless motor is used. Further, since the intermediate transfer belt 169 is not needed to correct color variations, a stepping motor is used. The respective motors are controlled by control signals from controller (not shown).

In the situation of FIG. 33, the electrostatic latent image of yellow (Y) is formed in the photosensitive drum 165, and a high voltage is applied to the developing roller 162*a*, such that an image of yellow is formed in the photosensitive drum 165. If all of the images on a rear side and a front side of yellow are carried on the intermediate transfer belt 169, the developing rotary 161*a* rotates by 90 degrees in the direction of the arrow A.

The intermediate transfer belt 169 rotates once and then returns to a position of the photosensitive drum 165. Next, both-side image of cyan (C) is formed in the photosensitive drum 165, and the image is overlapped and carried on the image of yellow which is carried on the intermediate transfer belt 169. Similarly, the developing rotary 161 rotates by 90 degrees and, after carrying an image, rotates once to the intermediate transfer belt 169, repetitively.

In case of carrying a color image of four colors, the intermediate transfer belt 169 rotates four times, and then the rotation position is controlled, such that the image is transferred onto the paper at a position of the secondary transfer roller 171. The paper supplied from the supply paper tray 178 is transported to the transport path 174, and then the color image is transferred onto one side of the paper at a position of the secondary transfer roller 171. The paper onto one side of which the image is transferred is inverted by the discharging roller pair 176 and waits at the transport path. And then, the paper is transported to a position of the secondary transfer roller 171 at a suitable timing, such that the color image is transferred onto another side of the paper. In a housing 180, an exhaust fan 181 is provided.

In the above description, the line head of the present invention and the image forming device using the line head are described based on the examples, but the present invention is not limited to these examples and various modifications can be implemented.

As described above, according to the present invention, in the case in which a plurality of light-emitting elements are arranged in a line to be turned on, the positions of the feeding points of the power supply lines connected to the respective light-emitting elements are devised. Thus, even when the power supply lines are formed with the thin film wiring lines, it is possible to provide the line head which can equalize the amount of light emitted from the respective light-emitting elements, and the image forming device using the line head. Also, it is possible to provide the line head which can equalize the amount of light emitted from the respective light-emitting elements in spite of the turning-on patterns of respective light-emitting elements, and the image forming device using the line head. Further, it is possible to provide the line head which can suppresses the change of the voltages of the respective light-emitting elements, and the image forming device using the line head. Further, it is possible to provide the line head which can reduce the size of the line head when the plurality of light-emitting elements are arranged in one line, and to an image forming device using the same.

The present application is based on Japanese Patent Application No. 2003-375357 filed on Nov. 5, 2003, Japanese Patent Application No. 2003-375358 filed on Nov. 5, 2003, Japanese Patent Application No. 2003-381250 filed on Nov. 11, 2003, Japanese Patent Application No. 2003-381251 filed on Nov. 11, 2003, Japanese Patent Application No. 2003-381252 filed on Nov. 11, 2003, Japanese Patent Application No. 2003-396516 filed on Nov. 27, 2003, and Japanese Patent Application No. 2003-402552 filed on Dec. 2, 2003, the contents of these Japanese Patent Applications are employed as references.

What is claimed is:

1. A line head, comprising:

a first line connected to a first feeding point of a power supply and formed with a film wiring line;

a second line connected to a second feeding point of a ground and formed with a film wiring line;

a first light-emitting element connected between the first line and the second line;

a first electrical channel connected between the first line and the second line in parallel to the first light-emitting element, the first electrical channel into which the same current as that of the first light-emitting element flows; and a controller operable to control on/off state of the first light-emitting element and electrical connection state of the first electrical channel.

2. The line head according to claim 1, wherein the first electrical channel includes a light-emitting element having the same feature as the first light-emitting element.

3. The line head according to claim 1, wherein the first electrical channel includes a resistance.

4. The line head according to claim 3, the resistance includes a thin film resistance which is limited on a substrate on which the first light-emitting element is provided.

5. The line head according to claim 1, wherein the controller includes a pair of transistors which are respectively connected to one of the first light-emitting element and the first electrical channel; and wherein conductive layers of the respective transistors having different polarities.

6. The line head according to claim 1, wherein the controller includes a pair of transistors which are respectively connected to the first light-emitting element and one of the first electrical channel;

wherein conductive layers of the respective transistors having same polarities; and wherein the respective transistors are supplied with signals of which polarities are inverted to each other.

7. The line head according to claim 1, wherein one of the first and second feeding points is provided opposite to the other one of the first and second feeding points through the first light-emitting element.

8. The line head according to claim 1, wherein the first line is connected to a third feeding point of a power supply, which is provided opposite to the first feeding point through the first light-emitting element; and wherein the second line is connected to fourth feeding point of a ground, which is provided opposite to the second feeding point through the first light-emitting element.

9. The line head according to claim 1, further comprising:

a third line connected to a third feeding point of a power supply; and a fourth line connected to a fourth feeding point of a ground, wherein the first line is connected to the third feeding point and the second line is connected to the fourth feeding point.

10. The line head according to claim 9, wherein the third feeding point includes a plurality of feeding points of a power supply; and wherein the fourth feeding point includes a plurality of feeding points of a ground.

11. The line head according to claim 8, wherein the first light emitting element and a second light-emitting element are arranged in a main-scanning direction; and wherein plural sets of the first and second light-emitting elements are formed in a sub-scanning direction.

12. The line head according to claim 1, wherein the first light-emitting element of the line head includes one of organic EL element and LED.

13. An image forming device comprising:

at least two image forming stations each of which having:

an image carrier;

a charging section provided around the image carrier;

a line head as claimed in claim 1;

a developing section; and a transferring section, wherein a transferring medium passes through the respective image forming stations, so that an image is formed in a tandem manner.

14. An image forming device comprising:

an image carrier configured to carry an electrostatic latent image, a rotary developing unit; and a line head as claimed in claim 1, wherein the rotary developing unit carries toners stored in a plurality of toner cartridges on its surface, rotates in a predetermined direction to sequentially transport toners of different colors to positions opposing the image carrier, and applies a developing bias between the image carrier and the rotary developing unit to move the toners from the rotary developing unit to the image carrier such that the electrostatic latent image is developed to form a toner image.

15. The image forming device according to claim 13, further comprising an intermediate transferring member.

16. The image forming device according to claim 14, further comprising an intermediate transferring member.

17. The line head according to claim 1, wherein the first light-emitting element is turned off when the current flows in the first electrical channel, and turned on when the current does not flow into the first electrical channel.

18. The line head according to claim 1, further comprising:

a second light-emitting element connected between the first line and the second line; and a second electrical channel connected between the first line and the second line in parallel to the second light-emitting element, the second electrical channel into which the same current as that of the second light-emitting element flows, wherein the controller is operable to control on/off state of the first and second light emitting elements and electrical connection state of the first and second electrical channels.

* * * * *